US011965249B2

(12) United States Patent
Shoji et al.

(10) Patent No.: US 11,965,249 B2
(45) Date of Patent: Apr. 23, 2024

(54) SURFACE-TREATED METAL MATERIAL

(71) Applicant: NIPPON STEEL CORPORATION, Tokyo (JP)

(72) Inventors: Hiromasa Shoji, Tokyo (JP); Kiyokazu Ishizuka, Tokyo (JP); Kohei Tokuda, Tokyo (JP); Mamoru Saito, Tokyo (JP); Yasuto Goto, Tokyo (JP); Ikumi Tokuda, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 307 days.

(21) Appl. No.: 17/437,746

(22) PCT Filed: Mar. 19, 2020

(86) PCT No.: PCT/JP2020/012407
§ 371 (c)(1),
(2) Date: Sep. 9, 2021

(87) PCT Pub. No.: WO2020/189769
PCT Pub. Date: Sep. 24, 2020

(65) Prior Publication Data

US 2022/0145473 A1 May 12, 2022

(30) Foreign Application Priority Data

Mar. 19, 2019 (JP) ..... 2019-051864

(51) Int. Cl.

| | |
|---|---|
| ***C23C 28/00*** | (2006.01) |
| ***C22C 18/04*** | (2006.01) |
| ***C23C 22/36*** | (2006.01) |

(52) U.S. Cl.
CPC ..... *C23C 28/34* (2013.01); *C22C 18/04* (2013.01); *C23C 22/36* (2013.01); *Y10T 428/12569* (2015.01); *Y10T 428/12792* (2015.01)

(58) Field of Classification Search
None
See application file for complete search history.

(56) References Cited

U.S. PATENT DOCUMENTS

| | | | |
|---|---|---|---|
| 5,292,549 | A | 3/1994 | van Ooij et al. |
| 2003/0209293 | A1 | 11/2003 | Sako et al. |

(Continued)

FOREIGN PATENT DOCUMENTS

| | | | |
|---|---|---|---|
| JP | 8-73775 | A | 3/1996 |
| JP | 2001-49453 | A | 2/2001 |

(Continued)

*Primary Examiner* — Xiaobei Wang
(74) *Attorney, Agent, or Firm* — Birch, Stewart, Kolasch & Birch, LLP

(57) ABSTRACT

A surface-treated metal material includes a metal sheet, a plating layer formed on the metal sheet and containing aluminum, magnesium, and zinc, and a composite coating formed on a surface of the plating layer, the composite coating including an organic silicon compound, one or two of a zirconium compound and a titanium compound, a phosphoric acid compound, a fluorine compound, and a vanadium compound, wherein, when a surface of the composite coating is analyzed at a spot size of φ30 μm using micro-fluorescent X-rays, a maximum value of V/Zn, which is a mass ratio of a V content to a Zn content, is 0.010 to 0.100.

6 Claims, 1 Drawing Sheet

(56) References Cited

U.S. PATENT DOCUMENTS

| | | | | |
|---|---|---|---|---|
| 2009/0110921 | A1* | 4/2009 | Kaneto | C23C 22/44 428/447 |
| 2014/0050939 | A1* | 2/2014 | Morishita | C23C 22/44 428/626 |

FOREIGN PATENT DOCUMENTS

| | | | |
|---|---|---|---|
| JP | 2002-30460 | A | 1/2002 |
| JP | 2003-105562 | A | 4/2003 |
| JP | 2007-51365 | A | 3/2007 |
| JP | 2009-242815 | A | 10/2009 |
| JP | 5336002 | B2 | 11/2013 |
| WO | WO 01/12876 | A1 | 2/2001 |
| WO | WO 2010/070728 | A1 | 6/2010 |

* cited by examiner

SURFACE-TREATED METAL MATERIAL

TECHNICAL FIELD OF THE INVENTION

The present invention relates to a surface-treated metal material.

Priority is claimed on Japanese Patent Application No. 2019-051864, filed Mar. 19, 2019, the content of which is incorporated herein by reference.

RELATED ART

As techniques for forming a coating excellent in adhesion to the surface of a metal material and imparting corrosion resistance, fingerprint resistance or the like to the surface of a metal material, a method of applying chromate treatment to the surface of a metal material with a treatment solution containing chromic acid, bichromic acid or a salt thereof as a main component, a method of applying treatment using a chromium-free metal surface treatment agent, a method of applying phosphate treatment, a method of applying treatment with a silane coupling agent alone, a method of applying organic resin coating treatment and the like are generally known and practically used.

As a technique mainly using an inorganic component, for example, Patent Document 1 discloses a metal surface treatment agent containing a vanadium compound and a metal compound containing at least one metal selected from the group consisting of zirconium, titanium, molybdenum, tungsten, manganese and cerium.

On the other hand, as a technique mainly using a silane coupling agent, for example, Patent Document 2 discloses treatment for a metal sheet with an aqueous solution containing a low concentration of an organic functional silane and a crosslinking agent in order to obtain a temporary anticorrosive effect, and discloses a method of forming a dense siloxane film by crosslinking the organic functional silane with the crosslinking agent.

Patent Document 3 discloses that a non-chromium surface-treated steel sheet excellent in corrosion resistance, fingerprint resistance, blackening resistance, and coating adhesion can be obtained by using a surface treatment agent containing a specific resin compound (A), a cationic urethane resin (B) having at least one cationic functional group selected from the group consisting of primary to tertiary amino groups and a quaternary ammonium base, at least one silane coupling agent (C) having a specific reactive functional group, and a specific acid compound (E), in which the content of the cationic urethane resin (B) and the silane coupling agent (C) is within a predetermined range.

As a technique for using a silane coupling agent as a main component, Patent Document 4 discloses a technique in which a treatment solution having a specific pH is prepared from a treatment agent containing a silane coupling agent I having a specific functional group A and a silane coupling agent II having a heterologous functional group B capable of reacting with the functional group A, the treatment solution is applied to the surface of a metal material, and the treatment solution is heated and dried to form a coating containing a reaction product of the silane coupling agent I and the silane coupling agent II.

Patent Document 5 discloses a technique using a surface treatment agent for a metal material excellent in corrosion resistance containing, as components, (a) a compound having two or more functional groups of a specific structure and (b) at least one compound selected from the group consisting of an organic acid, a phosphoric acid, and a complex fluoride, and having a molecular weight of 100 to 30000 per functional group in the component (a).

However, the techniques of Patent Documents 1 to 3 do not satisfy all of corrosion resistance, heat resistance, fingerprint resistance, conductivity, coatability, and black doposit resistance during processing, and still have problems in practical use. Further, the techniques of Patent Documents 4 to 5 are techniques in which a silane coupling agent is used as a main component, in which a plurality of silane coupling agents are mixed and used. However, the hydrolyzability and the condensability of the silane coupling agent, the reactivity of the organic functional group, and the effect obtained thereby have not been sufficiently investigated, and a technique for sufficiently controlling the properties of a plurality of silane coupling agents has not been disclosed.

Further, Patent Document 6 discloses a chromate-free surface-treated metal material in which an aqueous metal surface treatment agent containing an organosilicon compound (W) obtained by blending two silane coupling agents having a specific structure at a specific mass ratio and a specific inhibitor is applied to the surface of a metal material and dried to form a composite coating containing the components.

Further, Patent Document 7 discloses a metal material subjected to an excellent chromate-free surface treatment excellent in each element of corrosion resistance, heat resistance, fingerprint resistance, conductivity, coatability, and black doposit resistance during processing, and a chromium-free metal surface treatment agent used for imparting excellent corrosion resistance and alkali resistance to the metal material.

The techniques disclosed in Patent Document 6 and Patent Document 7 are excellent techniques that have been put into practical use in a surface-treated steel sheet subjected to a chromate-free surface treatment excellent in corrosion resistance, heat resistance, fingerprint resistance, electrical conductivity, coatability, and black doposit resistance during processing.

However, the plating layer containing aluminum, magnesium and zinc has a plurality of phases. It has been found that when a coating is formed by performing the surface treatment disclosed in Patent Document 6 and Patent Document 7 on a metal material having such a plating layer on the surface thereof, there is a possibility of a difference in corrosion resistance occurring depending on a location and a region having low corrosion resistance being locally formed.

PRIOR ART DOCUMENT

Patent Document

[Patent Document 1] Japanese Unexamined Patent Application, First Publication No. 2002-30460
[Patent Document 2] U.S. Pat. No. 5,292,549
[Patent Document 3] Japanese Unexamined Patent Application, First Publication No. 2003-105562
[Patent Document 4] Japanese Unexamined Patent Application, First Publication No. 8-73775
[Patent Document 5] Japanese Unexamined Patent Application. First Publication No. 2001-49453
[Patent Document 6] Japanese Unexamined Patent Application, First Publication No. 2007-051365
[Patent Document 7] Japanese Patent No. 5336002

DISCLOSURE OF THE INVENTION

Problems to be Solved by the Invention

As described above, when a coating is formed by performing a conventional surface treatment on a plating layer having a plurality of phases, there is a possibility of a difference in corrosion resistance occurring depending on a location and a portion having low corrosion resistance being locally formed. In order to ensure sufficient corrosion resistance even in the region with the lowest corrosion resistance, the coating may be made to contain more of an inhibitor than necessary. However, in a case where more of the inhibitor than necessary is contained, performance such as coating adhesion deteriorates.

The present invention has been made in view of the above problems. An object of the present invention is to provide a surface-treated metal material excellent in corrosion resistance on the entire surface on which surface treatment has been performed and also excellent in heat resistance, fingerprint resistance, conductivity, coatability, and black doposit resistance during processing.

Means for Solving the Problem

The present inventors have studied a method for preventing the formation of a region having low corrosion resistance without increasing the inhibitor content from a conventional level. As a result, the present inventors have found that, in a surface-treated metal material having a coating such as a chemical conversion coating on a plating layer, by unevenly distributing an inhibitor component contained in the coating in the coating such that a large amount of the inhibitor component is present in a region having low corrosion resistance, it is possible to suppress the local decrease in corrosion resistance without increasing the content of the inhibitor from the conventional level.

The present invention has been made based on the above findings, and the gist thereof is as follows.

(1) A surface-treated metal material according to an aspect of the present invention includes a metal sheet, a plating layer formed on the metal sheet and containing aluminum, magnesium, and zinc, and a composite coating formed on a surface of the plating layer, the composite coating including an organic silicon compound, one or two of a zirconium compound and a titanium compound, a phosphoric acid compound, a fluorine compound, and a vanadium compound, wherein, when a surface of the composite coating is analyzed at a spot size of φ30 μm using micro-fluorescent X-rays, a maximum value of V/Zn, which is a mass ratio of a V content to a Zn content, is 0.010 to 0.100.

(2) In the surface-treated metal material according to (1), in the composite coating, when analyzed with the micro-fluorescent X-rays at a spot size of φ30 μm, an area ratio of a region in which the V/Zn is 0.010 to 0.100 to an entire measurement range may be 1% to 50%.

(3) In the surface-treated metal material according to (1) or (2), in the composite coating, when analyzed with the micro-fluorescent X-rays at a spot size of φ30 μm, a maximum value of V/Si, which is a ratio of a solid content mass of V to a solid content mass of Si, may be 1.0 to 100.

(4) In the surface-treated metal material according to any one of (1) to (3), in the composite coating, when analyzed with the micro-fluorescent X-rays at a spot size of φ2 mm, an average value of (Zr+Ti)/Si, which is a ratio of a total solid content mass of one or two of Zr and Ti to a solid content mass of Si, may be 0.06 to 0.15, an average value of P/Si, which is a ratio of a solid content mass of P to the solid content mass of Si, may be 0.15 to 0.25, and an average value of V/Si may be 0.01 to 0.10.

(5) In the surface-treated metal material according to any one of (1) to (4), a chemical composition of the plating layer may contain Al: more than 4.0% to less than 25.0%, Mg: more than 1.0% to less than 12.5%, Sn: 0% to 20%, Bi: 0% to less than 5.0%, In: 0% to less than 2.0%, Ca: 0% to 3.0%, Y: 0% to 0.5%, La: 0% to less than 0.5%, Ce: 0% to less than 0.5%, Si: 0% to less than 2.5%, Cr: 0% to less than 0.25%, Ti: 0% to less than 0.25%. Ni: 0% to less than 0.25%, Co: 0% to less than 0.25%, V: 0% to less than 0.25%, Nb: 0% to less than 0.25%, Cu: 0% to less than 0.25%, Mn: 0% to less than 0.25%, Fe: 0% to 5.0%, Sr: 0% to less than 0.5%, Sb: 0% to less than 0.5%, Pb: 0% to less than 0.5%, and B: 0% to less than 0.5%, with a remainder of Zn and impurities.

Effects of the Invention

An object of the present invention is to provide a surface-treated metal material excellent in corrosion resistance on the entire surface on which surface treatment has been performed and also excellent in heat resistance, fingerprint resistance, conductivity, coatability, and black doposit resistance during processing.

EMBODIMENTS OF THE INVENTION

Hereinafter, a surface-treated metal material according to an embodiment of the present invention (a surface-treated metal material according to the present embodiment) will be described.

Figure 1:
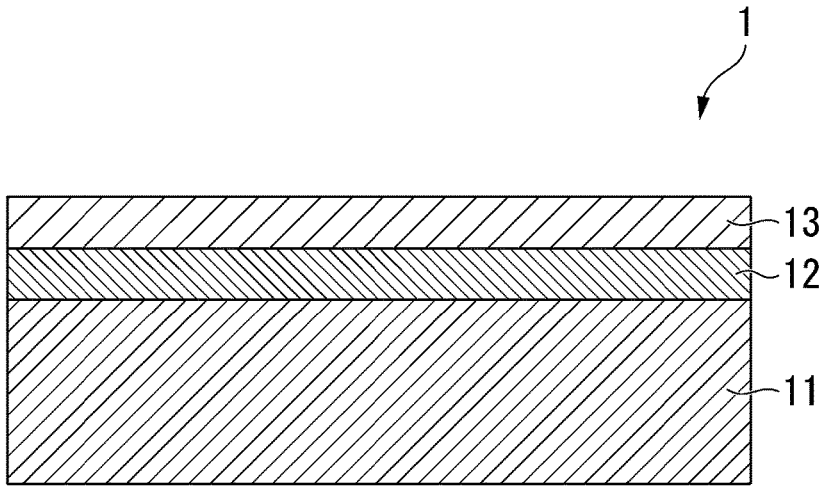
FIG. 1 is a schematic cross section view of a surface-treated metal material according to the present embodiment.

As shown in FIG. 1, the surface-treated metal material 1 according to the present embodiment includes a metal sheet 11, a plating layer 12 formed on the metal sheet 11 and containing aluminum, magnesium, and zinc, and a composite coating 13 formed on a surface of the plating layer 12 and containing an organic silicon compound, one or two of a zirconium compound and a titanium compound, a phosphoric acid compound, a fluorine compound, and a vanadium compound.

In FIG. 1, the plating layer 12 and the composite coating 13 are formed on only one side of the metal sheet 11, but they may be formed on both sides.

Hereinafter, the metal sheet 11, the plating layer 12, and the composite coating 13 will be described.

<Metal Sheet 11>

The surface-treated metal material 1 according to the present embodiment has excellent corrosion resistance, heat resistance, fingerprint resistance, conductivity, coatability, and black doposit resistance during processing due to the plating layer 12 and the composite coating 13. Therefore, the metal sheet 11 is not particularly limited. It may be determined depending on the product to be applied, the required strength, the sheet thickness, and the like. For example, a hot rolled steel sheet described in JIS G3193:2008 or a cold rolled steel sheet described in JIS G3141:2017 may be used.

<Plating Layer 12>

The plating layer 12 included in the surface-treated metal material 1 according to the present embodiment is formed on the surface of the metal sheet 11 and contains aluminum, magnesium, and zinc. Plating containing aluminum, magnesium, and zinc has higher corrosion resistance than plating consisting of zinc or plating consisting of zinc and aluminum. In the surface-treated metal material 1 according to the present embodiment, the plating layer 12 contains aluminum, magnesium, and zinc in order to obtain excellent corrosion resistance.

The plating layer 12 preferably has a chemical composition of Al: more than 4.0% to less than 25.0%, Mg: more than 1.0% to less than 12.5%, Sn: 0% to 20%, Bi: 0% to less than 5.0%, In: 0% to less than 2.0%, Ca: 0% to 3.0%, Y: 0% to 0.5%, La: 0% to less than 0.5%, Ce: 0% to less than 0.5%, Si: 0% to less than 2.5%, Cr: 0% to less than 0.25%, Ti: 0% to less than 0.25%, Ni: 0% to less than 0.25%, Co: 0% to less than 0.25%, V: 0% to less than 0.25%, Nb: 0% to less than 0.25%, Cu: 0% to less than 0.25%, Mn: 0% to less than 0.25%, Fe: 0% to 5.0%, Sr: 0% to less than 0.5%, Sb: 0% to less than 0.5%, Pb: 0% to less than 0.5%, and B: 0% to less than 0.5%, with the remainder of Zn and impurities.

The reason for the preferable chemical composition of the plating layer 12 will be described.

[Al: More than 4.0% to Less than 25.0%]

Al is an element effective for ensuring corrosion resistance in a plating layer containing aluminum (Al), zinc (Zn), and magnesium (Mg). In order to sufficiently obtain the above effect, the Al content is preferably set to more than 4.0%.

On the other hand, when the Al content is 25.0% or more, the corrosion resistance of the cut end face of the plating layer is decreased. Therefore, the Al content is preferably less than 25.0%.

[Mg: More than 1.0% to Less than 12.5%]

Mg is an element having an effect of enhancing the corrosion resistance of the plating layer. In order to sufficiently obtain the above effect, the Mg content is preferably set to more than 1.0%.

On the other hand, when the Mg content is 12.5% or more, the effect of improving the corrosion resistance is saturated and the workability of the plating layer deteriorates. In addition, problems in manufacturing such as an increase in the amount of dross generated in the plating bath occur. Therefore, the Mg content is preferably set to less than 12.5%.

The plating layer may contain Al and Mg, with the remainder being Zn and impurities. However, the following elements may be further contained if necessary.

[Sn: 0% to 20%]

[Bi: 0% to less than 5.0%]

[In: 0% to less than 2.0%]

When these elements are contained in the plating layer, a $Mg_2Sn$ phase $Mg_3Bi_2$ phase, $Mg_3In$ phase, and the like are formed as new intermetallic compound phases in the plating layer.

These elements form an intermetallic compound phase only with Mg without forming an intermetallic compound phase with any of Zn and Al constituting the plating layer main body. When a new intermetallic compound phase is formed, the weldability of the plating layer changes greatly. All of the intermetallic compound phases have a high melting point and therefore exist as intermetallic compound phases without evaporation after welding. Mg, which is originally likely to be oxidized by welding heat to form MgO, is not oxidized because it forms intermetallic compound phases with Sn, Bi, and In, and remains as intermetallic compound phases even after welding, making it easier to remain as plating layer. Therefore, the presence of these elements improves corrosion resistance and sacrificial protection corrosion resistance, and improves corrosion resistance around the welded part. In order to obtain the above effects, the content of each component is preferably set to 0.05% or more.

Among them, Sn is preferable because it is a low melting point metal and can be easily contained without impairing the properties of the plating bath.

[Ca: 0% to 3.0%]

When Ca is contained in the plating layer, the amount of dross that is likely to be formed during the plating operation decreases as the Mg content increases, and the plating operability improves. Therefore, Ca may be contained. In order to obtain this effect, the Ca content is preferably set to 0.1% or more.

On the other hand, when the Ca content is high, the corrosion resistance itself of the flat surface portion of the plating layer tends to deteriorate, and the corrosion resistance around the welded part may also deteriorate. Therefore, even when it is contained, the Ca content is preferably 3.0% or less.

[Y: 0% to 0.5%]

[La: 0% to less than 0.5%]

[Ce: 0% to less than 0.5%]

Y, La, and Ce are elements that contribute to the improvement of corrosion resistance. In order to obtain this effect, it is preferable to contain one or more thereof each in an amount of 0.05% or more.

On the other hand, when the content of these elements is excessive, the viscosity of the plating bath increases, the bath preparation itself often becomes difficult, and a plated steel material having good plating properties cannot be manufactured. Therefore, even when they are contained, it is preferable that the Y content be set to 0.5% or less, the La content be set to less than 0.5%, and the Ce content be set to less than 0.5%.

[Si: 0% to less than 2.5%]

Si is an element that forms a compound together with Mg and contributes to the improvement of corrosion resistance. In addition, Si is also an element having an effect of suppressing an alloy layer formed between the surface of the metal sheet and the plating layer from being formed excessively thick when the plating layer is formed on the metal sheet, and enhancing the adhesion between the metal sheet and the plating layer. In order to obtain this effect, the Si content is preferably set to 0.1% or more. More preferably, it is 0.2% or more.

On the other hand, when the Si content is 2.5% or more, the excess Si is precipitated in the plating layer, and not only does the corrosion resistance decrease but the workability of the plating layer also decreases. Therefore, the Si content is preferably set to less than 2.5%. More preferably, it is 1.5% or less.

[Cr: 0% to less than 0.25%]

[Ti: 0% to less than 0.25%]

[Ni: 0% to less than 0.25%]

[Co: 0% to less than 0.25%]

[V: 0% to less than 0.25%]

[Nb: 0% to less than 0.25%]

[Cu: 0% to less than 0.25%]

[Mn: 0% to less than 0.25%]

These elements are elements that contribute to the improvement of corrosion resistance. In order to obtain this effect, the content of each element is preferably set to 0.05% or more.

On the other hand, when the content of these elements is excessive, the viscosity of the plating bath increases, the bath preparation itself often becomes difficult, and a plated metal material having good plating properties cannot be manufactured. Therefore, the content of each element is preferably set to less than 0.25%.

[Fe: 0% to 5.0%]

Fe is mixed into the plating layer as an impurity when the plating layer is manufactured. The content may be up to about 5.0%, but within this range, the adverse effect on the effect of the surface-treated metal material according to the present embodiment is small. Therefore, the Fe content is preferably set to 5.0% or less.

[Sr: 0% to less than 0.5%]

[Sb: 0% to less than 0.5%]

[Pb: 0% to less than 0.5%]

When Sr. Sb, and Pb are contained in the plating layer, the external appearance of the plating layer is changed, spangles are formed, and improved metallic luster is confirmed. In order to obtain this effect, the content of each of Sr, Sb, and Pb is preferably set to 0.05% or more.

On the other hand, when the content of these elements is excessive, the viscosity of the plating bath increases, the bath preparation itself often becomes difficult, and a plated metal material having good plating properties cannot be manufactured. Therefore, it is preferable that the Sr content be set to less than 0.5%, the Sb content be set to less than 0.5%, and the Pb content be set to less than 0.5%.

[B: 0% to less than 0.5%]

B is an element that, when contained in the plating layer, combines with Zn, Al, and Mg to form various intermetallic compound phases. These intermetallic compounds have the effect of improving LME. In order to obtain this effect, the B content is preferably set to 0.05% or more.

On the other hand, when the B content becomes excessive, the melting point of the plating rises remarkably, the plating operability deteriorates, and a plated metal material having good plating properties cannot be obtained. Therefore, the B content is preferably set to less than 0.5%.

The amount of adhesion of the plating layer 12 is not limited, but it is preferably 10 g/m$^2$ or more in order to improve the corrosion resistance. On the other hand, even when the amount of adhesion exceeds 200 g/m$^2$, the corrosion resistance is saturated and it becomes economically disadvantageous. Therefore, the amount of adhesion is preferably 200 g/m$^2$ or less.

<Composite Coating 13>

The composite coating 13 provided on the surface of the plating layer 12 in the surface-treated metal material 1 according to the present embodiment includes an organic silicon compound, one or two of a zirconium compound and a titanium compound, a phosphoric acid compound, a fluorine compound, and a vanadium compound. When the composite coating contains an organic silicon compound, one or two of a zirconium compound and a titanium compound, a phosphoric acid compound, a fluorine compound, and a vanadium compound, corrosion resistance, heat resistance, fingerprint resistance, conductivity, coatability, and black doposit resistance during processing can be imparted to the surface-treated metal material 1.

However, as described above, in the surface-treated metal material 1 according to the present embodiment, a plating layer containing aluminum, magnesium, and zinc is used as the plating layer 12 in order to ensure corrosion resistance. Such a plating layer containing aluminum, magnesium, and zinc has a plurality of phases.

When a coating such as a conventional chemical conversion treatment coating is formed on a plating layer having a plurality of phases, there is a possibility of a difference in corrosion resistance occurring depending on a location and a region having low corrosion resistance being formed. When there is a region having low corrosion resistance, corrosion occurs from that region, and thus, in the surface-treated metal material 1, it is necessary to ensure sufficient corrosion resistance even in the region having the lowest corrosion resistance.

In order to ensure sufficient corrosion resistance even in the region with the lowest corrosion resistance, it is conceivable to increase the content of the inhibitor in the coating, which contributes to the improvement of corrosion resistance. However, in a case where more of the inhibitor than necessary is contained, other performance such as coating adhesion deteriorates. Therefore, it is not preferable to simply increase the content of the inhibitor in the coating.

The present inventors have studied a method for improving the corrosion resistance of the composite coating 13, particularly the corrosion resistance in a region where the corrosion resistance is low, without increasing the content of the inhibitor in the composite coating 13. As a result, they found that the corrosion resistance can be improved without increasing the content of the inhibitor in the entire composite coating 13 by uniformly distributing components constituting the matrix such as an organic silicon compound, a zirconium compound and/or a titanium compound, a phosphoric acid compound and a fluorine compound and distributing a vanadium compound (V compound) acting as an inhibitor to be present in a large amount in a region having low corrosion resistance and present in an average amount in other regions in the composite coating 13.

More specifically, they found that the vanadium compound may be distributed such that the maximum value of V/Zn, which is the mass ratio between the V content and the Zn content, is 0.010 to 0.100 when the surface of the composite coating 13 is analyzed using micro-fluorescent X-rays.

Vanadium compounds are usually dispersed almost uniformly in the matrix of the coating, but by making the treatment solution applied on the plating layer 12 acidic and controlling the conditions from application to baking to the conditions described below, the inhibitor components can be concentrated in the region having low corrosion resistance during the process of applying the treatment solution and baking. Although this mechanism is not clear, in a case where the treatment solution is acidic, when the treatment solution is applied, the region having low corrosion resistance in the plating layer 12 is selectively corroded and zinc is eluted. As the zinc is eluted, the ambient pH rises. V ions are deposited in the portion where the pH rises and becomes alkaline, and vanadium compounds such as $V(OH)_4$ are precipitated. This vanadium compound acts as an inhibitor. That is, it is assumed that V is concentrated in a region where the corrosion resistance was low, and the corrosion resistance of the portion is improved. When the treatment solution is neutral or alkaline, the stability of the treatment solution becomes poor.

In the metal sheet of the present embodiment, when the maximum value of V/Zn is 0.010 or more, it can be said that V is sufficiently concentrated in the region where the corrosion resistance was low. On the other hand, when the maximum value of V/Zn exceeds 0.100, although V is concentrated in the region where the corrosion resistance was initially low, the V content of portions other than the concentrated portion is decreased due to excessive concentration of V, and the corrosion resistance as a whole is decreased, which is not preferable.

When the surface of the composite coating 13 is analyzed by micro-fluorescent X-rays, information up to a certain depth can be obtained by the micro-fluorescent X-rays, and thus Zn contained in the plating layer 12 is detected. Since it is known that this Zn is dispersed substantially uniformly, it can be determined that V is concentrated in the region where V/Zn is high.

Conventionally, in order to prevent the elution of the inhibitor, there has been a technique to uniformly adsorb a resin or the like in the vicinity of the surface of the coating or in the vicinity of the interface between the coating and the plating layer. However, in the metal sheet according to the present embodiment, V is concentrated in a region having low corrosion resistance to improve the corrosion resistance. The fact that the corrosion resistance of the coating can be improved by such a method is a finding newly found by the present inventors. In addition, in the surface-treated metal material 1 according to the present embodiment, a sufficient V-concentrated region can be formed by securing a time in which V is concentrated at a temperature higher than a normal temperature during the formation of the composite coating 13. Such concentration of V during coating formation has not been proposed in the past, and is a method based on a new technical idea.

In the composite coating 13, the area ratio of the region in which V/Zn is 0.010 to 0.100 (V-concentrated region) to the entire measurement range is preferably 1% to 50%. In this case, it is possible to improve the corrosion resistance by concentrating V in the region where the corrosion resistance was initially low while suppressing a decrease in the corrosion resistance in the region other than the V-concentrated region, which is preferable.

Further, in the composite coating 13, the maximum value of V/Si, which is the ratio of the solid content mass of V to the solid content mass of Si, is preferably 1.0 to 100. When the maximum value of V/Si is 1.0 to 100, the balance between the concentration (precipitation) of V and the integrity of the coating becomes good.

Further, because the maximum value of V/Si, which is the ratio of the solid content mass of Si derived from the organic silicon compound and the solid content mass of V derived from the vanadium compound contained in the matrix of the composite coating 13, is independent of the presence or absence of Si in the plating layer 12, the concentration of V can be known. In the composite coating 13 included in the surface-treated metal material 1 according to the present embodiment, the maximum value of V/Si of 1.0 to 100 is also an index indicating the presence of a V-concentrated region. It is assumed that the V concentration is caused by the selective corrosion of a region having low corrosion resistance in the plating layer 12, the elution of zinc, the rise of the ambient pH, and the precipitation of V ions as vanadium compounds such as $V(OH)_4$ in the portion which has become alkaline, thereby imparting barrier properties and improving the corrosion resistance of the portion. When the maximum value of V/Si is 1.0 to 100, it is considered that the vanadium compound is precipitated in the region having low corrosion resistance.

Further, in the composite coating 13, it is preferable that the average value of (Zr+Ti)/Si, which is the ratio of the solid content mass of Zr derived from the zirconium compound and/or the solid content mass of Ti derived from the titanium compound to the solid content mass of Si derived from the organic silicon compound, be 0.06 to 0.15, so that the homogeneity of the composite coating 13 is maintained. When the average value of (Zr+Ti)/Si is less than 0.06, there is a concern that the corrosion resistance may decrease due to insufficient barrier properties. Further, when the average value of (Zr+Ti)/Si exceeds 0.15, the corrosion resistance is saturated. The average value of (Zr+Ti)/Si is preferably 0.08 to 0.12.

Further, it is preferable that the average value of P/Si, which is the ratio of the solid content mass of P derived from the phosphoric acid compound to the solid content mass of Si derived from the organic silicon compound, be 0.15 to 0.25, so that the homogeneity of the composite coating 13 is maintained. When the average value of P/Si is less than 0.15, there is a concern that the corrosion resistance will tend to decrease due to the P shortage. Further, when the average value of P/Si exceeds 0.25, there is a concern of the coating becoming water-soluble, which is not preferable. The average value of P/Si is preferably 0.19 to 0.22.

Further, it is preferable that the average value of V/Si be 0.01 to 0.10 so that a state in which the V compound is appropriately precipitated in the region having low corrosion resistance is obtained while the homogeneity of the composite coating 13 is maintained. When the average value of V/Si is less than 0.01, there is a concern of the corrosion resistance decreasing due to the shortage of V, which is a corrosion inhibitor. Further, when the average value of V/Si exceeds 0.10, there is a concern of the coating becoming water-soluble, which is not preferable. The average value of V/Si is preferably 0.04 to 0.07.

The maximum value of V/Ln, the area ratio of V-concentrated region, the maximum value of V/Si, the average value of (Zr+Ti)/Si, the average value of the P/Si, and the average value of V/Si can be measured using micro-fluorescent X-rays.

Specifically, the maximum value of V/Zn, the area ratio of the V-concentrated region, and the maximum value of V/Si are obtained by measuring the mass percent of V, Zn, and Si in the detectable element constituting the composite coating 13, the plating layer 12, and the metal sheet 11 with the number of pixels of 256×200 in a region having a spot size of φ30 μm and a lateral direction of about 2.3 mm and a longitudinal direction of about 1.5 mm with respect to the surface of the composite coating by using micro-fluorescent X-rays (manufactured by AMETEK, Orbis energy-dispersive X-ray fluorescence spectrometer, tube voltage: 5 kV, tube current: 1 mA) and Rh as an X-ray source, and calculating from the results.

Further, the average value of Zr/Si, the average value of P/Si, and the average value of V/Si are obtained by measuring the mass percent of Zr, P, V, and Si in the detectable element constituting the composite coating 13, the plating layer 12, and the metal sheet 11 in the irradiation region (2 mmφ) in a region having a spot size of φ2 mm with respect to the surface of the composite coating by using micro-fluorescent X-rays (manufactured by AMETEK, Orbis energy-dispersive X-ray fluorescence spectrometer, tube voltage: 5 kV, tube current: 1 mA) and Rh as an X-ray source, and calculating from the results.

In the present embodiment, the organic silicon compound contained in the composite coating 13 is not limited, but is obtained by blending, for example, a silane coupling agent (A) containing one amino group in the molecule and a silane coupling agent (B) containing one glycidyl group in the molecule at a solid content mass ratio [(A)/(B)] of 0.5 to 1.7.

The blending ratio of the silane coupling agent (A) and the silane coupling agent (B) is preferably 0.5 to 1.7 in terms of solid content mass ratio [(A)/(B)]. When the solid content mass ratio [(A)/(B)] is less than 0.5, fingerprint resistance, bath stability, and black doposit resistance may be significantly decreased. On the other hand, when it exceeds 1.7, the water resistance may be significantly decreased, which is not preferable. [(A)/(B)] is more preferably 0.7 to 1.7, and still more preferably 0.9 to 1.1.

Examples of the silane coupling agent (A) containing one amino group include, but are not particularly limited to, 3-aminopropyltriethoxysilane and 3-aminopropyltrimethoxysilane, and examples of the silane coupling agent (B) containing one glycidyl group in the molecule include 3-glycidoxypropyltrimethoxysilane and 3-glycidoxypropyltriethoxysilane.

In the present embodiment, examples of the vanadium compound (V) contained in the composite coating 13 include, but are not particularly limited to, vanadium pentoxide $V_2O_5$, metavanadate $HVO_3$, ammonium metavanadate, sodium metavanadate, vanadium oxytrichloride $VOCl_3$, vanadium trioxide $V_2O_3$, vanadium dioxide $VO_2$, vanadium oxysulfate $VOSO_4$, vanadium oxyacetyl acetonate $VO(OC(=CH_2)CH_2COCH_3)_2$, vanadium acetylacetonate $V(OC(=CH_2)CH_2COCH_3)_3$, vanadium trichloride $VCl_3$, and phosphovanadomolybdic acid. Further, a pentavalent vanadium compound reduced to a tetravalent or divalent vanadium compound by an organic compound having at least one functional group selected from the group consisting of a hydroxyl group, a carbonyl group, a carboxyl group, a primary to tertiary amino group, an amide group, a phosphoric acid group, and a phosphonic acid group can also be used.

In the present embodiment, examples of the phosphoric acid compound contained in the composite coating 13 include, but are not particularly limited to, phosphoric acid, ammonium phosphate, potassium phosphate, and sodium phosphate. Of these, phosphoric acid is more preferable. When phosphoric acid is used, better corrosion resistance can be obtained.

In the present embodiment, examples of the fluorine compound contained in the composite coating 13 include, but are not particularly limited to, fluorides such as hydrofluoric acid, fluoroboric acid, fluorosilicic acid, and water-soluble salts thereof, and complex fluoride salts. Of these, hydrofluoric acid is more preferable. When hydrofluoric acid is used, better corrosion resistance and coatability can be obtained.

In the present embodiment, examples of the zirconium compound and/or the titanium compound contained in the composite coating 13 include, but are not particularly limited to, zirconium hydrofluoric acid, ammonium hexafluoride zirconium, zirconium sulfate, zirconium oxychloride, zirconium nitrate, zirconium acetate, ammonium hexafluorotitanate, and titanium hydrofluoric acid. Of these, zircon hydrofluoric acid or titanium hydrofluoric acid is more preferable. When zirconium hydrofluoric acid or titanium hydrofluoric acid is used, better corrosion resistance and coatability can be obtained.

Further, zirconium hydrofluoric acid or titanium hydrofluoric acid is preferable because it also acts as a fluorine compound.

The amount of adhesion of the composite coating is preferably 0.05 to 2.0 $g/m^2$, more preferably 0.2 to 1.0 $g/m^2$, and most preferably 0.3 to 0.6 $g/m^2$. When the amount of adhesion of the coating is less than 0.05 $g/m^2$, the surface of the metal material cannot be coated and the corrosion resistance is significantly decreased, which is not preferable. On the other hand, when it is larger than 2.0 $g/m^2$, the black doposit resistance during processing is decreased, which is not preferable.

Next, a preferable manufacturing method of the surface-treated metal material 1 according to the present embodiment will be described. The effect of the surface-treated metal material 1 according to the present embodiment can be obtained regardless of the manufacturing method as long as the surface-treated metal material 1 has the above-described characteristics. However, stable manufacture can be achieved with a manufacturing method including the following steps.

The surface-treated metal material according to the present embodiment is obtained with a manufacturing method including a plating step of forming a plating layer on the surface of a metal material by immersing the metal material such as a steel sheet in a plating bath containing Zn, Al, and Mg, an applying step of applying the surface treatment metal agent to the metal material having the plating layer, and a composite coating forming step of forming a composite coating containing an organic silicon compound, one or two of a zirconium compound and a titanium compound, a phosphoric acid compound, a fluorine compound, and a vanadium compound by heating (baking) the metal material to which the surface treatment metal agent is applied.

[Plating Step]

The plating step is not particularly limited. A usual method may be used so that sufficient plating adhesion is obtained.

Further, the method for manufacturing the metal material to be used in the plating process is not limited.

[Applying Step]

In the applying step, a surface treatment metal agent containing an organic silicon compound, one or two of a zirconium compound and a titanium compound, a phosphoric acid compound, a fluorine compound, and a vanadium compound is applied to the metal material having a plating layer.

The ratio (such as X/W, Y/W, and Z/W, where X/W means (X1+X2)/W) of one or two of a zirconium compound and a titanium compound (X2), a phosphoric acid compound (Y), a fluorine compound (X1), and a vanadium compound (Z) to an organic silicon compound (W) is preferably adjusted in accordance with the ratio of the target coating.

Further, in order to form the V-concentrated region, it is preferable to make the surface treatment metal agent (treatment solution) to be applied acidic. By making the treatment solution acidic, the region having low corrosion resistance in the plating layer is selectively corroded and zinc is eluted. The pH around the zinc-eluted portion rises. In the portion where the pH rises and becomes alkaline, V ions are deposited before the treatment solution dries, and vanadium compounds such as $V(OH)_4$ are precipitated. As a result, V is concentrated in the region where the corrosion resistance was low, and a V-concentrated region is formed.

The pH of the treatment solution can be adjusted by using organic acids such as acetic acid and lactic acid, inorganic acids such as hydrofluoric acid, and pH adjusters such as ammonium salts and amines.

When better corrosion resistance is required, it is preferable that the surface treatment metal agent be applied within 10 to 60 seconds as elapsed time including retaining the atmosphere at a humidity of 80% or more for 2 to 5 seconds, after plating (after the plating is completed) and the temperature change of the plating layer is controlled to be 300° C. to 450° C. within this 10 to 60 seconds. Through this control, the average value of V/Si, the average value of P/Si, and the average value of (Zr+Ti)/Si fall within preferable ranges. In this case, the corrosion resistance is further improved.

In order to control the average value of V/Si, the average value of P/Si, and the average value of (Zr+Ti)/Si to be within the preferable ranges, at least two preferred conditions among the time from plating to coating, the holding atmosphere humidity, the retention time, and the temperature change of the plating layer need to be satisfied. Further, in the case of a more preferable range, it is necessary to satisfy three or more preferable conditions.

The reason why these conditions affect the improvement of corrosion resistance is not clear, but a possible mechanism for, for example, the average value of V/Si will be described with reference to FIG. 2.

Figure 2:
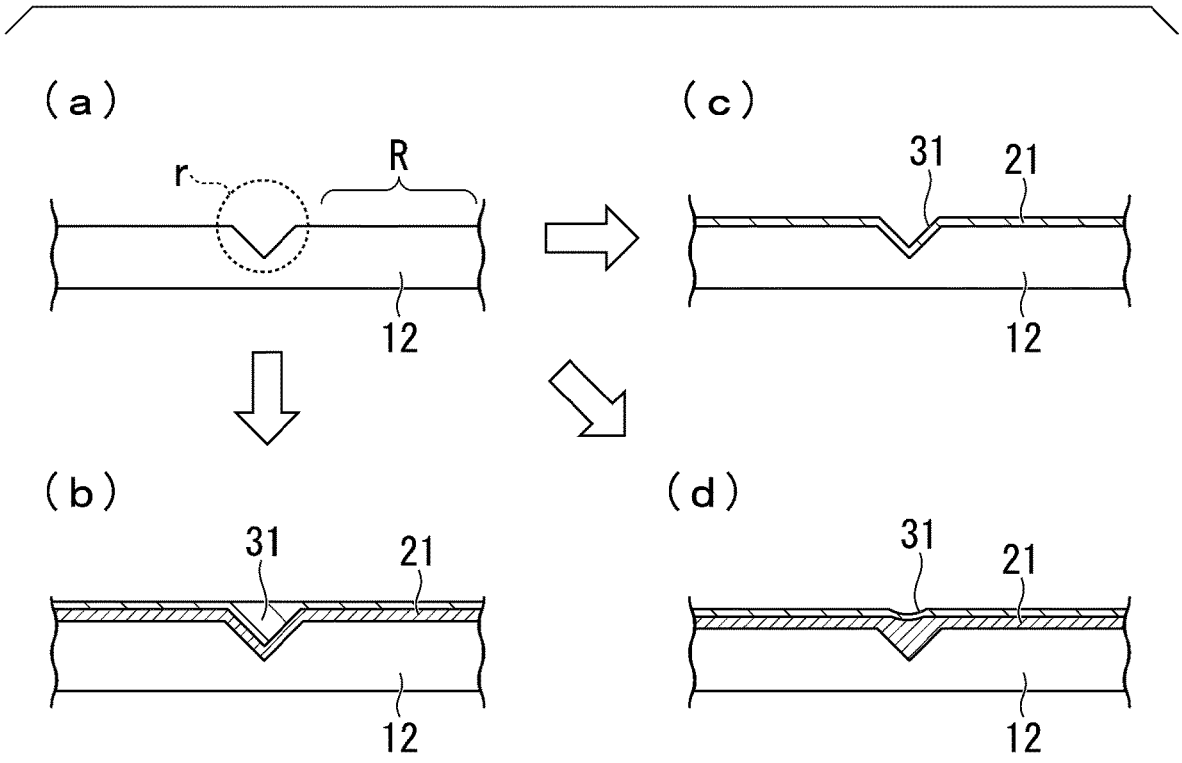
FIG. 2 is a diagram for explaining an assumed mechanism of concentration of a vanadium compound.

As shown in FIG. 2(*a*), a case where a region r having low corrosion resistance exists on the surface of the plating layer 12 after plating will be examined.

The surface of the plating layer 12 after plating is in an active state. Therefore, as shown in FIG. 2(*b*), an oxide film 21 is formed on the surface of the plating layer 12. In order to form the oxide film 21 with an appropriate thickness, after plating, a treatment solution is applied to the surface of the plating layer 12 with in the range from 10 to 60 seconds as elapsed time including retaining the plating layer 12 for 2 to 5 seconds in an atmosphere having a humidity of 80% or higher, and the temperature of the plating layer 12 is changed to 300° C. to 450° C. in this 10 to 60 seconds. Even when the oxide film 21 is formed in the low corrosion resistance region r of the surface of the plating layer 12, the reaction between the V compound and the surface of the plating layer 12 selectively proceeds in the low corrosion resistance region due to application of the coating liquid. As a result, as shown in FIG. 2(*b*), the V compound 31 is concentrated in the region r having low corrosion resistance. On the other hand, since the oxide film 21 is formed with an appropriate thickness in the other region R of the surface of the plating layer 12, the reaction between the V compound and the surface of the plating layer 12 is relatively smaller than in the region r even when the treatment solution is applied. Therefore, the V compound 31 is not concentrated in the "other region R". That is, in the "region r having low corrosion resistance", the V-compound 31 is concentrated and the corrosion resistance is improved, whereas in the "other region R", although the V-compound 31 is not concentrated, a small amount of the V-compound 31 is present and the oxide film 21 is formed with a sufficient thickness, so that the corrosion resistance can be maintained.

On the other hand, when the treatment solution is applied to the surface of the plating layer 12 within less than 10 seconds from the plating, the thickness of the oxide film 21 on the surface of the plating layer 12 is not sufficient as shown in FIG. 2(*c*) even when the treatment solution is previously retained for 2 to 5 seconds in an atmosphere having a humidity of 80% or more and the temperature change is 300° C. to 450° C. As described above, when the oxide film 21 is not formed with a sufficient thickness, or when the oxide film 21 is not formed, the reactivity between the region r having low corrosion resistance on the surface of the plating layer 12 and the other region R is not greatly changed. Therefore, the V compound 31 is similarly precipitated on the entire surface of the plating layer 12, and the V compound 31 cannot be selectively precipitated in the region r having low corrosion resistance. Therefore, the improvement of the corrosion resistance of the region r having low corrosion resistance due to the precipitation of the V compound 31 becomes insufficient.

On the other hand, when the time from plating to application exceeds 60 seconds, as shown in FIG. 2(*d*), the oxide film 21 grows too thick even in the region r on the surface of the plating layer 12 having low corrosion resistance. Therefore, even when the treatment solution is applied after 60 seconds have passed from the plating, a selective reaction with the treatment solution is unlikely to occur even in the region r on the surface of the plating layer 12 having low corrosion resistance. Therefore it is impossible to selectively precipitate V compounds 31 in a low region r corrosion resistance, and due to the precipitation of V compounds 31, improvement in corrosion resistance of low region r becomes insufficient.

Further, when the temperature change of the plating layer 12 within 10 to 60 seconds as elapsed time after plating, is less than 300° C., the selective reaction between the region r having low corrosion resistance on the surface of the plating layer 12 and the treatment solution is unlikely to occur. Therefore, the V compound 31 is not sufficiently concentrated in the region r having low corrosion resistance. It is presumed that this is because the difference in the reactivity to the treatment solution between the region r having low corrosion resistance on the surface of the plating layer 12 and the other region R becomes small due to insufficient temperature change of the plating layer 12.

On the other hand, when the temperature change is more than 450° C., the oxide film 21 may grow sufficiently and the reactivity with the coating liquid may not be secured.

In addition, even when the plating layer 12 is not retained in an atmosphere having a humidity of 80% or more for 2 seconds or more before the treatment solution is applied, a selective reaction between a region r having low corrosion resistance on the surface of the plating layer 12 and the treatment solution is hardly caused. It is presumed that this is because the thickness of the oxide film 21 becomes insufficient due to the insufficient growth time of the oxide film 21 in the atmosphere, and the difference between the reactivity between the region r having low corrosion resistance on the surface of the plating layer 12 and the treatment solution and the reactivity between the other region R and the treatment solution becomes small. It is presumed that when the retention time is more than 5 seconds, the oxide film 21 grows too thick even in the region r having low corrosion resistance on the surface of the plating layer 12, and the difference between the reactivity between the region r having low corrosion resistance on the surface of the plating layer 12 and the treatment solution and the reactivity between the other region R and the treatment solution becomes small.

In the applying step, the application method of the surface treatment metal agent is not limited.

For example, the application can be performed using a roll coater, a bar coater, a spray, or the like.

[Composite Coating Forming Step]

In the composite coating forming step, the metal material to which the surface treatment metal agent is applied is heated to a peak metal temperature above 50° C. and below 250° C. (highest peak metal temperature), dried, and baked. Regarding the drying temperature, when the peak metal temperature is 50° C. or less, the solvent of the aqueous metal surface treatment agent does not completely volatilize, which is not preferable. On the other hand, when the temperature is 250° C. or more, a part of the organic chain of the coating formed by the aqueous metal surface treatment agent is decomposed, which is not preferable. The peak metal temperature is more preferably 60° C. to 150° C., and still more preferably 80° C. to 150° C.

Further, in the composite coating forming step, it is preferable to start heating 0.5 seconds or more after applying the surface treatment metal agent. By setting the time from application to heating (coating film retention time) to 0.5 seconds or more, it is possible to sufficiently secure a time until V ions are deposited and a vanadium compound such as $V(OH)_4$ is precipitated. When the time to heating is less than 0.5 seconds, the concentration of V becomes insufficient.

When applying a surface treatment metal agent to the plating layer 12 on a roll coater, the temperature of the metal sheet 11 when the metal sheet 11 enters the roll coater (hereinafter sometimes referred to as "metal sheet entry temperature") is preferably 5° C. or more and 80° C. or less. When the metal sheet entry temperature exceeds the above upper limit of 80° C., depending on the composition of the surface treatment metal agent, the evaporation of water in the aqueous surface treatment agent may be too rapid, resulting in a phenomenon in which small bubble-like blisters or holes are generated, a so-called Waki phenomenon. The metal sheet entry temperature is more preferably 10° C. or more and 60° C. or less, and still more preferably 15° C. or more and 40° C. or less.

The temperature of the surface treatment metal agent at the time of application of the surface treatment metal agent onto the plating layer 12 is not particularly limited, but may be, for example, 5° C. or more and 60° C. or less, preferably 10° C. or more and 50° C. or less, and more preferably 15° C. or more and 40° C. or less. By setting the temperature of the aqueous surface treatment agent at the time of coating within the above range, coating using a roll coater can be performed with excellent productivity, and the composite coating 13 can be formed.

When the surface treatment metal agent is applied onto the plating layer 12, Co treatment is preferably performed. The cobalt compound is present as an ion in the treatment solution, and when the cobalt compound comes into contact with the metal, the cobalt compound is substituted and precipitated on the metal surface. By carrying out the Co treatment, it is possible to develop excellent blackening resistance by modifying the metal surface with the cobalt compound.

EXAMPLES

Example 1

The metal sheets were immersed in a plating bath to obtain metal sheets M1 to M7 having a plating layer shown in Table 1. In the description of Table 1, for example. "Zn-0.5% Mg-0.2% A1" means that Mg is contained in an amount of 0.5% by mass and Al is contained in an amount of 0.2% by mass, with the remainder being Zn and impurities.

The amount of adhesion of the plating layer was 90 g/m$^2$.

As the metal sheet, a cold-rolled steel sheet described in JIS G 3141:2017 was used.

A surface treatment metal agent containing an organic silicon compound, one or two of a zirconium compound and a titanium compound, a phosphoric acid compound, a fluorine compound, and a vanadium compound, as shown in Tables 2-1 to 2-10, and having an adjusted temperature was applied as a coating liquid to a metal material having a plating layer of M1 to M7 appropriately heated to a metal sheet entry sheet temperature shown in Tables 2-1 to 2-10 using a roll coater without degreasing after plating. When the surface treatment metal agent was applied onto the plating layer, Co-treatment was performed for some examples.

Thereafter, the metal sheet was washed with water for 10 seconds using a spray.

The viscosity of the surface treatment metal agent in each example at 25° C. was in the range of 1 to 2 mPa-s.

Further, in the table, in the "silane coupling agent" of the organic silicon compound, A1, A2, B1 and B2 indicate the following.

A1: 3-aminopropyltrimethoxysilane

A2: 3-aminopropyltriethoxysilane

B1: 3-glycidoxypropyltrimethoxysilane

B2: 3-glycidoxypropyltriethoxysilane

Further, in the V compound, Z1 and Z2 indicate the following.

Z1: vanadium oxysulfate $VOSO_4$,

Z2: vanadium oxyacetylacetonate $VO(OC(=CH_2)CH_2COCH_3)_2$.

After applying the surface treatment metal agent and allowing the coating film retention time in Tables 2-1 to 2-10 to elapse, the metal material to which the surface treatment metal agent was applied was heated to the maximum reached sheet temperatures of Tables 2-1 to 2-10, dried, and baked. The coating film retention time was adjusted by controlling the transfer speed of the steel sheet from the roll coater to the heating furnace.

With respect to the obtained composite coating, the maximum value of V/Zn, the area ratio of the region in which V/Zn is 0.010 to 0.100 to the entire measurement range, the maximum value of V/Si, the average value of (Zr+Ti)/Si, the average value of P/Si, and the average value of V/Si were measured using micro-fluorescent X-rays.

Specifically, the maximum value of V/Zn, the area ratio of the V-concentrated region, and the maximum value of V/Si were obtained by measuring the mass percent of V, Zn, and Si in the detectable element constituting the composite coating, the plating layer, and the metal sheet with the number of pixels of 256×200 in a region having a spot size of φ30 μm and a lateral direction of about 2.3 mm and a longitudinal direction of about 1.5 mm with respect to the surface of the composite coating by using micro-fluorescent X-rays (manufactured by AMETEK, Orbis energy-dispersive X-ray fluorescence spectrometer, tube voltage: 5 kV, tube current: 1 mA) and Rh as an X-ray source, and calculating from the results.

Further, the average value of (Zr+Ti)/Si, the average value of P/Si, and the average value of V/Si were obtained by measuring the mass percent of Zr, P, V, and Si in the detectable elements constituting the composite coating, the plating layer, and the metal sheet in the irradiation region (2 mmφ) in a region having a spot size of φ2 mm with respect to the surface of the composite coating by using micro-fluorescent X-rays (manufactured by AMETEK, Orbis energy-dispersive X-ray fluorescence spectrometer, tube voltage: 5 kV, tube current: 1 mA) and Rh as an X-ray source, and calculating from the results.

Further, the corrosion resistance of the obtained surface-treated metal material was evaluated.

"Corrosion Resistance"

A flat sheet test piece was prepared.

First, each test piece was subjected to a salt spray test in accordance with JIS Z 2371:2015, and the occurrence status of white rust on the surface after 72 hours (the ratio of the area where white rust occurred to the area of the test piece) was evaluated.

The white rust generation rate was determined by binarizing the corrosion evaluation surface of the plating layer, determining a threshold value at which a non-corroded portion and a white rust portion could be separated from each other, and measuring an area ratio of a white portion using image processing software.

The evaluation criteria for corrosion resistance are shown below. When the evaluation was 3 or 4, it was determined that the corrosion resistance was excellent.

4: 5% or less
3: more than 5% and 15% or less
2: more than 15% and 30% or less
1: more than 30%

TABLE 1

| Metal sheet No. | Plating layer composition (% by mass) |
|---|---|
| M-1 | Zn-0.5% Mg-0.2% Al |
| M-2 | Zn-11% Al-3% Mg-0.2% Si |
| M-3 | Zn-16% Al-6% Mg-0.2% Si |
| M-4 | Zn-19% Al-6% Mg-1.5% Sn-0.5% Ca-0.2% Si |
| M-5 | Zn-24% Al-12% Mg-0.5% Ca-1.2% Si |
| M-6 | Zn-0.2% Al |
| M-7 | Zn-11% Al-3% Mg-0.2% Si-0.05% Ni |

TABLE 2-1

| | Organic silicon compound (W) | | | | | Fluorine compound (X1) zirconium compound or titanium compound (X2) | | Phosphoric acid compound (Y) | | V compound (Z) | |
|---|---|---|---|---|---|---|---|---|---|---|---|
| | Base material | Silane coupling agent A | Silane coupling agent B | Ratio A/B | Molecular weight | Type | Ratio X/W | Type | Ratio Y/W | Type | Ratio Z/W |
| Inventive Example 1 | M-2 | A1 | B1 | 0.5 | 3000 | $TiF_6^{2-}$ | 0.10 | Phosphoric acid | 0.20 | Z1 | 0.075 |
| Inventive Example 2 | M-2 | A1 | B1 | 1.0 | 3000 | $TiF_6^{2-}$ | 0.10 | Phosphoric acid | 0.20 | Z1 | 0.075 |
| Inventive Example 3 | M-2 | A1 | B1 | 2.0 | 3000 | $TiF_6^{2-}$ | 0.10 | Phosphoric acid | 0.20 | Z1 | 0.075 |
| Inventive Example 4 | M-2 | A2 | B1 | 0.5 | 3000 | $TiF_6^{2-}$ | 0.10 | Phosphoric acid | 0.20 | Z1 | 0.075 |
| Inventive Example 5 | M-2 | A2 | B1 | 1.0 | 3000 | $TiF_6^{2-}$ | 0.10 | Phosphoric acid | 0.20 | Z1 | 0.075 |
| Inventive Example 111 | M-2 | A2 | B1 | 1.0 | 3000 | $TiF_6^{2-}$ $ZrF_6^{2-}$ | 0.05 | Phosphoric acid | 0.20 | Z1 | 0.075 |
| Inventive Example 109 | M-7 | A2 | B1 | 1.0 | 3000 | $TiF_6^{2-}$ | 0.10 | Phosphoric acid | 0.20 | Z1 | 0.075 |
| Inventive Example 107 | M-2 | A2 | B1 | 1.0 | 3000 | $TiF_6^{2-}$ | 0.10 | Ammonium phosphate salt | 0.20 | Z1 | 0.075 |
| Inventive Example 108 | M-2 | A2 | B1 | 1.0 | 3000 | $TiF_6^{2-}$ | 0.10 | Sodium phosphate salt | 020 | Z1 | 0.075 |
| Inventive Example 6 | M-2 | A2 | B1 | 2.0 | 3000 | $TiF_6^{2-}$ | 0.10 | Phosphoric acid | 0.20 | Z1 | 0.075 |
| Inventive Example 7 | M-2 | A1 | B2 | 0.5 | 3000 | $TiF_6^{2-}$ | 0.10 | Phosphoric acid | 0.20 | Z1 | 0.075 |
| Inventive Example 8 | M-2 | A1 | B2 | 1.0 | 3000 | $TiF_6^{2-}$ | 0.10 | Phosphoric acid | 0.20 | Z1 | 0.075 |
| Inventive Example 9 | M-2 | A1 | B2 | 2.0 | 3000 | $TiF_6^{2-}$ | 0.10 | Phosphoric acid | 0.20 | Z1 | 0.075 |
| Inventive Example 10 | M-2 | A2 | B2 | 0.5 | 3000 | $TiF_6^{2-}$ | 0.10 | Phosphoric acid | 0.20 | Z1 | 0.075 |
| Inventive Example 11 | M-2 | A2 | B2 | 1.0 | 3000 | $TiF_6^{2-}$ | 0.10 | Phosphoric acid | 0.20 | Z1 | 0.075 |
| Inventive Example 12 | M-2 | A2 | B2 | 2.0 | 3000 | $TiF_6^{2-}$ | 0.10 | Phosphoric acid | 0.20 | Z1 | 0.075 |
| Inventive Example 13 | M-2 | A2 | B1 | 1.0 | 1500 | $TiF_6^{2-}$ | 0.10 | Phosphoric acid | 0.20 | Z1 | 0.075 |
| Inventive Example 14 | M-2 | A2 | B1 | 1.0 | 6000 | $TiF_6^{2-}$ | 0.10 | Phosphoric acid | 0.20 | Z1 | 0.075 |
| Inventive Example 15 | M-2 | A2 | B1 | 1.0 | 9000 | $TiF_6^{2-}$ | 0.10 | Phosphoric acid | 0.20 | Z1 | 0.075 |
| Inventive Example 16 | M-2 | A2 | B1 | 1.0 | 3000 | $TiF_6^{2-}$ | 0.05 | Phosphoric acid | 0.20 | Z1 | 0.075 |
| Inventive Example 17 | M-2 | A2 | B1 | 1.0 | 3000 | $TiF_6^{2-}$ | 0.10 | Phosphoric acid | 0.10 | Z1 | 0.075 |
| Inventive Example 18 | M-2 | A2 | B1 | 1.0 | 3000 | $TiF_6^{2-}$ | 0.10 | Phosphoric acid | 0.20 | Z1 | 0.075 |
| Inventive Example 19 | M-2 | A2 | B1 | 1.0 | 3000 | $TiF_6^{2-}$ | 0.10 | Phosphoric acid | 0.30 | Z1 | 0.075 |
| Inventive Example 20 | M-2 | A2 | B1 | 1.0 | 3000 | $TiF_6^{2-}$ | 0.15 | Phosphoric acid | 0.20 | Z1 | 0.075 |
| Inventive Example 21 | M-2 | A2 | B1 | 1.0 | 3000 | $TiF_6^{2-}$ | 0.10 | Phosphoric acid | 0.20 | Z2 | 0.075 |
| Inventive Example 22 | M-2 | A2 | B1 | 1.0 | 3000 | $TiF_6^{2-}$ | 0.10 | Phosphoric acid | 0.20 | Z1 | 0.025 |

TABLE 2-1-continued

| | Organic silicon compound (W) | | | | | Fluorine compound (X1) zirconium compound or titanium compound (X2) | | Phosphoric acid compound (Y) | | V compound (Z) | |
|---|---|---|---|---|---|---|---|---|---|---|---|
| | Base material | Silane coupling agent A | Silane coupling agent B | Ratio A/B | Molecular weight | Type | Ratio X/W | Type Phosphoric acid | Ratio Y/W | Type | Ratio Z/W |
| Inventive Example 23 | M-2 | A2 | B1 | 1.0 | 3000 | $TiF_6^{2-}$ | 0.10 | Phosphoric acid | 0.20 | Z1 | 0.050 |
| Inventive Example 24 | M-2 | A2 | B1 | 1.0 | 3000 | $TiF_6^{2-}$ | 0.10 | Phosphoric acid | 0.20 | Z1 | 0.100 |

TABLE 2-2

| | Organic silicon compound (W) | | | | | Fluorine compound (X1) zirconium compound or titanium compound (X2) | | Phosphoric acid compound (Y) | | V compound (Z) | |
|---|---|---|---|---|---|---|---|---|---|---|---|
| | Base material | Silane coupling agent A | Silane coupling agent B | Ratio A/B | Molecular weight | Type | Ratio X/W | Type Phosphoric acid | Ratio Y/W | Type | Ratio Z/W |
| Inventive Example 25 | M-2 | A2 | B1 | 1.0 | 3000 | $TiF_6^{2-}$ | 0.10 | Phosphoric acid | 0.20 | Z1 | 0.200 |
| Inventive Example 26 | M-2 | A2 | B1 | 1.0 | 3000 | $TiF_6^{2-}$ | 0.10 | Phosphoric acid | 0.20 | Z1 | 0.075 |
| Inventive Example 27 | M-2 | A2 | B1 | 1.0 | 3000 | $TiF_6^{2-}$ | 0.10 | Phosphoric acid | 0.20 | Z1 | 0.075 |
| Inventive Example 28 | M-2 | A2 | B1 | 1.0 | 3000 | $TiF_6^{2-}$ | 0.10 | Phosphoric acid | 0.20 | Z1 | 0.075 |
| Inventive Example 29 | M-2 | A2 | B1 | 1.0 | 3000 | $TiF_6^{2-}$ | 0.10 | Phosphoric acid | 0.20 | Z1 | 0.075 |
| Inventive Example 30 | M-2 | A2 | B1 | 1.0 | 3000 | $TiF_6^{2-}$ | 0.10 | Phosphoric acid | 0.20 | Z1 | 0.075 |
| Inventive Example 31 | M-2 | A2 | B1 | 1.0 | 3000 | $TiF_6^{2-}$ | 0.10 | Phosphoric acid | 0.20 | Z1 | 0.075 |
| Inventive Example 32 | M-2 | A2 | B1 | 1.0 | 3000 | $TiF_6^{2-}$ | 0.10 | Phosphoric acid | 0.20 | Z1 | 0.075 |
| Inventive Example 33 | M-2 | A2 | B1 | 1.0 | 3000 | $TiF_6^{2-}$ | 0.10 | Phosphoric acid | 0.20 | Z1 | 0.075 |
| Inventive Example 34 | M-2 | A2 | B1 | 1.0 | 3000 | $TiF_6^{2-}$ | 0.10 | Phosphoric acid | 0.20 | Z1 | 0.075 |
| Inventive Example 35 | M-2 | A2 | B1 | 1.0 | 3000 | $TiF_6^{2-}$ | 0.10 | Phosphoric acid | 0.20 | Z1 | 0.075 |
| Inventive Example 36 | M-2 | A2 | B1 | 1.0 | 3000 | $TiF_6^{2-}$ | 0.10 | Phosphoric acid | 0.20 | Z1 | 0.075 |
| Inventive Example 37 | M-2 | A2 | B1 | 1.0 | 3000 | $TiF_6^{2-}$ | 0.10 | Phosphoric acid | 0.20 | Z1 | 0.075 |
| Inventive Example 38 | M-2 | A2 | B1 | 1.0 | 3000 | $TiF_6^{2-}$ | 0.10 | Phosphoric acid | 0.20 | Z1 | 0.075 |
| Inventive Example 39 | M-2 | A2 | B1 | 1.0 | 3000 | $TiF_6^{2-}$ | 0.10 | Phosphoric acid | 0.20 | Z1 | 0.075 |
| Inventive Example 40 | M-2 | A2 | B1 | 1.0 | 3000 | $TiF_6^{2-}$ | 0.10 | Phosphoric acid | 0.20 | Z1 | 0.075 |
| Inventive Example 41 | M-2 | A2 | B1 | 1.0 | 3000 | $TiF_6^{2-}$ | 0.10 | Phosphoric acid | 0.20 | Z1 | 0.075 |
| Inventive Example 42 | M-2 | A2 | B1 | 1.0 | 3000 | $TiF_6^{2-}$ | 0.10 | Phosphoric acid | 0.20 | Z1 | 0.075 |
| Inventive Example 43 | M-2 | A2 | B1 | 1.0 | 3000 | $TiF_6^{2-}$ | 0.10 | Phosphoric acid | 0.20 | Z1 | 0.075 |
| Inventive Example 44 | M-2 | A2 | B1 | 1.0 | 3000 | $TiF_6^{2-}$ | 0.10 | Phosphoric acid | 0.20 | Z1 | 0.075 |
| Inventive Example 45 | M-2 | A2 | B1 | 1.0 | 3000 | $TiF_6^{2-}$ | 0.10 | Phosphoric acid | 0.20 | Z1 | 0.075 |
| Comparative Example 27 | M-2 | A2 | B1 | 1.0 | 3000 | $TiF_6^{2-}$ | 0.10 | Phosphoric acid | 0.20 | Z1 | 0.075 |
| Inventive Example 46 | M-2 | A2 | B1 | 1.0 | 3000 | $TiF_6^{2-}$ | 0.10 | Phosphoric acid | 0.20 | Z1 | 0.075 |
| Inventive Example 47 | M-1 | A2 | B1 | 1.0 | 3000 | $TiF_6^{2-}$ | 0.10 | Phosphoric acid | 0.20 | Z1 | 0.075 |
| Inventive Example 48 | M-3 | A2 | B1 | 1.0 | 3000 | $TiF_6^{2-}$ | 0.10 | Phosphoric acid | 0.20 | Z1 | 0.075 |
| Inventive Example 101 | M-3 | A2 | B1 | 1.0 | 3000 | $TiF_6^{2-}$ | 0.10 | Phosphoric acid | 0.20 | Z1 | 0.075 |
| Inventive Example 102 | M-3 | A2 | B1 | 1.0 | 3000 | $TiF_6^{2-}$ | 0.10 | Phosphoric acid | 0.20 | Z1 | 0.075 |
| Inventive Example 49 | M-4 | A2 | B1 | 1.0 | 3000 | $TiF_6^{2-}$ | 0.10 | Phosphoric acid | 0.20 | Z1 | 0.075 |

TABLE 2-3

| | Organic silicon compound (W) | | | | | Fluorine compound (X1) zirconium compound or titanium compound (X2) | | Phosphoric acid compound (Y) | | V compound (Z) | |
|---|---|---|---|---|---|---|---|---|---|---|---|
| | Base material | Silane coupling agent A | Silane coupling agent B | Ratio A/B | Molecular weight | Type | Ratio X/W | Type Phosphoric acid | Ratio Y/W | Type | Ratio Z/W |
| Inventive Example 103 | M-4 | A2 | B1 | 1.0 | 3000 | $TiF_6^{2-}$ | 0.10 | Phosphoric acid | 0.20 | Z1 | 0.075 |
| Inventive Example 104 | M-4 | A2 | B1 | 1.0 | 3000 | $TiF_6^{2-}$ | 0.10 | Phosphoric acid | 0.20 | Z1 | 0.075 |
| Inventive Example 50 | M-5 | A2 | B1 | 1.0 | 3000 | $TiF_6^{2-}$ | 0.10 | Phosphoric acid | 0.20 | Z1 | 0.075 |
| Inventive Example 105 | M-5 | A2 | B1 | 1.0 | 3000 | $TiF_6^{2-}$ | 0.10 | Phosphoric acid | 0.20 | Z1 | 0.075 |

TABLE 2-3-continued

| | Organic silicon compound (W) | | | | | Fluorine compound (X1) zirconium compound or titanium compound (X2) | | Phosphoric acid compound (Y) | | V compound (Z) | |
|---|---|---|---|---|---|---|---|---|---|---|---|
| | Base material | Silane coupling agent A | Silane coupling agent B | Ratio A/B | Molecular weight | Type | Ratio X/W | Type Phosphoric acid | Ratio Y/W | Type | Ratio Z/W |
| Inventive Example 106 | M-5 | A2 | B1 | 1.0 | 3000 | $TiF_6^{2-}$ | 0.10 | Phosphoric acid | 0.20 | Z1 | 0.075 |
| Comparative Example 25 | M-6 | A2 | B1 | 1.0 | 3000 | $TiF_6^{2-}$ | 0.10 | Phosphoric acid | 0.20 | Z1 | 0.075 |
| Inventive Example 51 | M-2 | A1 | B1 | 0.5 | 3000 | $ZrF_6^{2-}$ | 0.10 | Phosphmic acid | 0.20 | Z1 | 0.075 |
| Inventive Example 52 | M-2 | A1 | B1 | 1.0 | 3000 | $ZrF_6^{2-}$ | 0.10 | Phosphoric acid | 0.20 | Z1 | 0.075 |
| Inventive Example 53 | M-2 | A1 | B1 | 2.0 | 3000 | $ZrF_6^{2-}$ | 0.10 | Phosphoric acid | 0.20 | Z1 | 0.075 |
| Inventive Example 54 | M-2 | A2 | B1 | 0.5 | 3000 | $ZrF_6^{2-}$ | 0.10 | Phosphoric acid | 0.20 | Z1 | 0.075 |
| Inventive Example 55 | M-2 | A2 | B1 | 1.0 | 3000 | $ZrF_6^{2-}$ | 0.10 | Phosphoric acid | 0.20 | Z1 | 0.075 |
| Inventive Example 110 | M-7 | A2 | B1 | 1.0 | 3000 | $ZrF_6^{2-}$ | 0.10 | Phosphoric acid | 0.20 | Z1 | 0.075 |
| Inventive Example 56 | M-2 | A2 | B1 | 2.0 | 3000 | $ZrF_6^{2-}$ | 0.10 | Phosphoric acid | 0.20 | Z1 | 0.075 |
| Inventive Example 57 | M-2 | A1 | B2 | 0.5 | 3000 | $ZrF_6^{2-}$ | 0.10 | Phosphoric acid | 0.20 | Z1 | 0.075 |
| Inventive Example 58 | M-2 | A1 | B2 | 1.0 | 3000 | $ZrF_6^{2-}$ | 0.10 | Phosphoric acid | 0.20 | Z1 | 0.075 |
| Inventive Example 59 | M-2 | A1 | B2 | 2.0 | 3000 | $ZrF_6^{2-}$ | 0.10 | Phosphoric acid | 0.20 | Z1 | 0.075 |
| Inventive Example 60 | M-2 | A2 | B2 | 0.5 | 3000 | $ZrF_6^{2-}$ | 0.10 | Phosphoric acid | 0.20 | Z1 | 0.075 |
| Inventive Example 61 | M-2 | A2 | B2 | 1.0 | 3000 | $ZrF_6^{2-}$ | 0.10 | Phosphoric acid | 0.20 | Z1 | 0.075 |
| Inventive Example 62 | M-2 | A2 | B2 | 2.0 | 3000 | $ZrF_6^{2-}$ | 0.10 | Phosphoric acid | 0.20 | Z1 | 0.075 |
| Inventive Example 63 | M-2 | A2 | B1 | 1.0 | 1500 | $ZrF_6^{2-}$ | 0.10 | Phosphoric acid | 0.20 | Z1 | 0.075 |
| Inventive Example 64 | M-2 | A2 | B1 | 1.0 | 6000 | $ZrF_6^{2-}$ | 0.10 | Phosphoric acid | 0.20 | Z1 | 0.075 |
| Inventive Example 65 | M-2 | A2 | B1 | 1.0 | 9000 | $ZrF_6^{2-}$ | 0.10 | Phosphoric acid | 0.20 | Z1 | 0.075 |
| Inventive Example 66 | M-2 | A2 | B1 | 1.0 | 3000 | $ZrF_6^{2-}$ | 0.10 | Phosphoric acid | 0.20 | Z1 | 0.075 |
| Inventive Example 67 | M-2 | A2 | B1 | 1.0 | 3000 | $ZrF_6^{2-}$ | 0.10 | Phosphoric acid | 0.10 | Z1 | 0.075 |
| Inventive Example 68 | M-2 | A2 | B1 | 1.0 | 3000 | $ZrF_6^{2-}$ | 0.10 | Phosphoric acid | 0.20 | Z1 | 0.075 |
| Inventive Example 69 | M-2 | A2 | B1 | 1.0 | 3000 | $ZrF_6^{2-}$ | 0.10 | Phosphoric acid | 0.30 | Z1 | 0.075 |
| Inventive Example 70 | M-2 | A2 | B1 | 1.0 | 3000 | $ZrF_6^{2-}$ | 0.15 | Phosphoric acid | 0.20 | Z1 | 0.075 |
| Inventive Example 71 | M-2 | A2 | B1 | 1.0 | 3000 | $ZrF_6^{2-}$ | 0.10 | Phosphoric acid | 0.20 | Z2 | 0.075 |

TABLE 2-4

| | Organic silicon compound (W) | | | | | Fluorine compound (X1) zirconium compound or titanium compound (X2) | | Phosphoric acid compound (Y) | | V compound (Z) | |
|---|---|---|---|---|---|---|---|---|---|---|---|
| | Base material | Silane coupling agent A | Silane coupling agent B | Ratio A/B | Molecular weight | Type | Ratio X/W | Type Phosphoric acid | Ratio Y/W | Type | Ratio Z/W |
| Inventive Example 72 | M-2 | A2 | B1 | 1.0 | 3000 | $ZrF_6^{2-}$ | 0.10 | Phosphoric acid | 0.20 | Z1 | 0.025 |
| Inventive Example 73 | M-2 | A2 | B1 | 1.0 | 3000 | $ZrF_6^{2-}$ | 0.10 | Phosphoric acid | 0.20 | Z1 | 0.050 |
| Inventive Example 74 | M-2 | A2 | B1 | 1.0 | 3000 | $ZrF_6^{2-}$ | 0.10 | Phosphoric acid | 0.20 | Z1 | 0.100 |
| Inventive Example 75 | M-2 | A2 | B1 | 1.0 | 3000 | $ZrF_6^{2-}$ | 0.10 | Phosphoric acid | 0.20 | Z1 | 0.200 |
| Inventive Example 76 | M-2 | A2 | B1 | 1.0 | 3000 | $ZrF_6^{2-}$ | 0.10 | Phosphoric acid | 0.20 | Z1 | 0.075 |
| Inventive Example 77 | M-2 | A2 | B1 | 1.0 | 3000 | $ZrF_6^{2-}$ | 0.10 | Phosphoric acid | 0.20 | Z1 | 0.075 |
| Inventive Example 78 | M-2 | A2 | B1 | 1.0 | 3000 | $ZrF_6^{2-}$ | 0.10 | Phosphoric acid | 0.20 | Z1 | 0.075 |
| Inventive Example 79 | M-2 | A2 | B1 | 1.0 | 3000 | $ZrF_6^{2-}$ | 0.10 | Phosphoric acid | 0.20 | Z1 | 0.075 |
| Inventive Example 80 | M-2 | A2 | B1 | 1.0 | 3000 | $ZrF_6^{2-}$ | 0.10 | Phosphoric acid | 0.20 | Z1 | 0.075 |
| Inventive Example 81 | M-2 | A2 | B1 | 1.0 | 3000 | $ZrF_6^{2-}$ | 0.10 | Phosphoric acid | 0.20 | Z1 | 0.075 |
| Inventive Example 82 | M-2 | A2 | B1 | 1.0 | 3000 | $ZrF_6^{2-}$ | 0.10 | Phosphoric acid | 0.20 | Z1 | 0.075 |
| Inventive Example 83 | M-2 | A2 | B1 | 1.0 | 3000 | $ZrF_6^{2-}$ | 0.10 | Phosphoric acid | 0.20 | Z1 | 0.075 |
| Inventive Example 84 | M-2 | A2 | B1 | 1.0 | 3000 | $ZrF_6^{2-}$ | 0.10 | Phosphoric acid | 0.20 | Z1 | 0.075 |
| Inventive Example 85 | M-2 | A2 | B1 | 1.0 | 3000 | $ZrF_6^{2-}$ | 0.10 | Phosphoric acid | 0.20 | Z1 | 0.075 |
| Inventive Example 86 | M-2 | A2 | B1 | 1.0 | 3000 | $ZrF_6^{2-}$ | 0.10 | Phosphoric acid | 0.20 | Z1 | 0.075 |
| Inventive Example 87 | M-2 | A2 | B1 | 1.0 | 3000 | $ZrF_6^{2-}$ | 0.10 | Phosphoric acid | 0.20 | Z1 | 0.075 |
| Inventive Example 88 | M-2 | A2 | B1 | 1.0 | 3000 | $ZrF_6^{2-}$ | 0.10 | Phosphoric acid | 0.20 | Z1 | 0.075 |
| Inventive Example 89 | M-2 | A2 | B1 | 1.0 | 3000 | $ZrF_6^{2-}$ | 0.10 | Phosphoric acid | 0.20 | Z1 | 0.075 |
| Inventive Example 90 | M-2 | A2 | B1 | 1.0 | 3000 | $ZrF_6^{2-}$ | 0.10 | Phosphoric acid | 0.20 | Z1 | 0.075 |
| Inventive Example 91 | M-2 | A2 | B1 | 1.0 | 3000 | $ZrF_6^{2-}$ | 0.10 | Phosphoric acid | 0.20 | Z1 | 0.075 |
| Inventive Example 92 | M-2 | A2 | B1 | 1.0 | 3000 | $ZrF_6^{2-}$ | 0.10 | Phosphoric acid | 0.20 | Z1 | 0.075 |
| Inventive Example 93 | M-2 | A2 | B1 | 1.0 | 3000 | $ZrF_6^{2-}$ | 0.10 | Phosphoric acid | 0.20 | Z1 | 0.075 |
| Inventive Example 94 | M-2 | A2 | B1 | 1.0 | 3000 | $ZrF_6^{2-}$ | 0.10 | Phosphoric acid | 0.20 | Z1 | 0.075 |
| Inventive Example 95 | M-2 | A2 | B1 | 1.0 | 3000 | $ZrF_6^{2-}$ | 0.10 | Phosphoric acid | 0.20 | Z1 | 0.075 |
| Comparative Example 28 | M-2 | A2 | B1 | 1.0 | 3000 | $ZrF_6^{2-}$ | 0.10 | Phosphoric acid | 0.20 | Z1 | 0.075 |
| Inventive Example 96 | M-2 | A2 | B1 | 1.0 | 3000 | $ZrF_6^{2-}$ | 0.10 | Phosphoric acid | 0.20 | Z1 | 0.075 |
| Inventive Example 97 | M-1 | A2 | B1 | 1.0 | 3000 | $ZrF_6^{2-}$ | 0.10 | Phosphoric acid | 0.20 | Z1 | 0.075 |
| Inventive Example 98 | M-3 | A2 | B1 | 1.0 | 3000 | $ZrF_6^{2-}$ | 0.10 | Phosphoric acid | 0.20 | Z1 | 0.075 |

TABLE 2-5

| | Organic silicon compound (W) | | | | | Fluorine compound (X1) zirconium compound or titanium compound (X2) | | Phosphoric acid compound (Y) | | V compound (Z) | |
|---|---|---|---|---|---|---|---|---|---|---|---|
| | Base material | Silane coupling agent A | Silane coupling agent B | Ratio A/B | Molecular weight | Type | Ratio X/W | Type Phosphoric acid | Ratio Y/W | Type | Ratio Z/W |
| Inventive Example 99 | M-4 | A2 | B1 | 1.0 | 3000 | $ZrF_6^{2-}$ | 0.10 | Phosphoric acid | 0.20 | Z1 | 0.075 |
| Inventive Example 100 | M-5 | A2 | B1 | 1.0 | 3000 | $ZrF_6^{2-}$ | 0.10 | Phosphoric acid | 0.20 | Z1 | 0.075 |
| Comparative Example 6 | M-6 | A2 | B1 | 1.0 | 3000 | $ZrF_6^{2-}$ | 0.10 | Phosphoric acid | 0.20 | Z1 | 0.075 |
| Comparative Example 1 | M-1 | A2 | B1 | 1.0 | 3000 | $TiF_6^{2-}$ | 0.10 | Phosphoric acid | 0.20 | Z1 | 0.075 |
| Comparative Example 2 | M-1 | A2 | B1 | 1.0 | 3000 | $TiF_6^{2-}$ | 0.10 | Phosphoric acid | 0.20 | Z1 | 0.075 |
| Comparative Example 3 | M-2 | A2 | B1 | 1.0 | 3000 | $TiF_6^{2-}$ | 0.10 | Phosphoric acid | 0.20 | Z1 | 0.075 |
| Comparative Example 4 | M-2 | A2 | B1 | 1.0 | 3000 | $TiF_6^{2-}$ | 0.10 | Phosphoric acid | 0.20 | Z1 | 0.075 |
| Comparative Example 5 | M-3 | A2 | B1 | 1.0 | 3000 | $TiF_6^{2-}$ | 0.10 | Phosphoric acid | 0.20 | Z1 | 0.075 |
| Comparative Example 6 | M-3 | A2 | B1 | 1.0 | 3000 | $TiF_6^{2-}$ | 0.10 | Phosphoric acid | 0.20 | Z1 | 0.075 |
| Comparative Example 7 | M-4 | A2 | B1 | 1.0 | 3000 | $TiF_6^{2-}$ | 0.10 | Phosphoric acid | 0.20 | Z1 | 0.075 |
| Comparative Example 8 | M-4 | A2 | B1 | 1.0 | 3000 | $TiF_6^{2-}$ | 0.10 | Phosphoric acid | 0.20 | Z1 | 0.075 |
| Comparative Example 9 | M-5 | A2 | B1 | 1.0 | 3000 | $TiF_6^{2-}$ | 0.10 | Phosphoric acid | 0.20 | Z1 | 0.075 |
| Comparative Example 10 | M-5 | A2 | B1 | 1.0 | 3000 | $TiF_6^{2-}$ | 0.10 | Phosphoric acid | 0.20 | Z1 | 0.075 |
| Comparative Example 21 | M-6 | A2 | B1 | 1.0 | 3000 | $TiF_6^{2-}$ | 0.10 | Phosphoric acid | 0.20 | Z1 | 0.075 |
| Comparative Example 22 | M-6 | A2 | B1 | 1.0 | 3000 | $TiF_6^{2-}$ | 0.10 | Phosphoric acid | 0.20 | Z1 | 0.075 |
| Comparative Example 11 | M-1 | A2 | B1 | 1.0 | 3000 | $ZrF_6^{2-}$ | 0.10 | Phosphoric acid | 0.20 | Z1 | 0.075 |
| Comparative Example 12 | M-1 | A2 | B1 | 1.0 | 3000 | $ZrF_6^{2-}$ | 0.10 | Phosphoric acid | 0.20 | Z1 | 0.075 |
| Comparative Example 13 | M-2 | A2 | B1 | 1.0 | 3000 | $ZrF_6^{2-}$ | 0.10 | Phosphoric acid | 0.20 | Z1 | 0.075 |
| Comparative Example 14 | M-2 | A2 | B1 | 1.0 | 3000 | $ZrF_6^{2-}$ | 0.10 | Phosphoric acid | 0.20 | Z1 | 0.075 |
| Comparative Example 15 | M-3 | A2 | B1 | 1.0 | 3000 | $ZrF_6^{2-}$ | 0.10 | Phosphoric acid | 0.20 | Z1 | 0.075 |
| Comparative Example 16 | M-3 | A2 | B1 | 1.0 | 3000 | $ZrF_6^{2-}$ | 0.10 | Phosphoric acid | 0.20 | Z1 | 0.075 |
| Comparative Example 17 | M-4 | A2 | B1 | 1.0 | 3000 | $ZrF_6^{2-}$ | 0.10 | Phosphoric acid | 0.20 | Z1 | 0.075 |
| Comparative Example 18 | M-4 | A2 | B1 | 1.0 | 3000 | $ZrF_6^{2-}$ | 0.10 | Phosphoric acid | 0.20 | Z1 | 0.075 |
| Comparative Example 19 | M-5 | A2 | B1 | 1.0 | 3000 | $ZrF_6^{2-}$ | 0.10 | Phosphoric acid | 0.20 | Z1 | 0.075 |
| Comparative Example 20 | M-5 | A2 | B1 | 1.0 | 3000 | $ZrF_6^{2-}$ | 0.10 | Phosphoric acid | 0.20 | Z1 | 0.075 |
| Comparative Example 23 | M-6 | A2 | B1 | 1.0 | 3000 | $ZrF_6^{2-}$ | 0.10 | Phosphoric acid | 0.20 | Z1 | 0.075 |
| Comparative Example 24 | M-6 | A2 | B1 | 1.0 | 3000 | $ZrF_6^{2-}$ | 0.10 | Phosphoric acid | 0.20 | Z1 | 0.075 |

TABLE 2-6

| | Coating solution acidic/ neutral/ alkaline | Metal sheet entry temperature into coater (° C.) | Surface treatment metal material temperature (° C.) | Coating film retention time (see) | Maximum reached sheet temperature (° C.) | Co treatment | Composite coating adhesion amount ($g/m^2$) |
|---|---|---|---|---|---|---|---|
| Inventive Example 1 | Acidic | 30 | 30 | 2 | 80 | Yes | 0.3 |
| Inventive Example 2 | Acidic | 30 | 30 | 2 | 80 | Yes | 0.3 |
| Inventive Example 3 | Acidic | 30 | 30 | 2 | 80 | Yes | 0.3 |
| Inventive Example 4 | Acidic | 30 | 30 | 2 | 80 | Yes | 0.3 |
| Inventive Example 5 | Acidic | 30 | 30 | 2 | 80 | Yes | 0.3 |
| Inventive Example 111 | Acidic | 30 | 30 | 2 | 80 | Yes | 0.3 |
| Inventive Example 109 | Acidic | 30 | 30 | 2 | 80 | Yes | 0.3 |
| Inventive Example 107 | Acidic | 30 | 30 | 2 | 80 | Yes | 0.3 |
| Inventive Example 108 | Acidic | 30 | 30 | 2 | 80 | Yes | 0.3 |
| Inventive Example 6 | Acidic | 30 | 30 | 2 | 80 | Yes | 0.3 |
| Inventive Example 7 | Acidic | 30 | 30 | 2 | 80 | Yes | 0.3 |
| Inventive Example 8 | Acidic | 30 | 30 | 2 | 80 | Yes | 0.3 |
| Inventive Example 9 | Acidic | 30 | 30 | 2 | 80 | Yes | 0.3 |
| Inventive Example 10 | Acidic | 30 | 30 | 2 | 80 | Yes | 0.3 |
| Inventive Example 11 | Acidic | 30 | 30 | 2 | 80 | Yes | 0.3 |
| Inventive Example 12 | Acidic | 30 | 30 | 2 | 80 | Yes | 0.3 |
| Inventive Example 13 | Acidic | 30 | 30 | 2 | 80 | Yes | 0.3 |
| Inventive Example 14 | Acidic | 30 | 30 | 2 | 80 | Yes | 0.3 |
| Inventive Example 15 | Acidic | 30 | 30 | 2 | 80 | Yes | 0.3 |
| Inventive Example 16 | Acidic | 30 | 30 | 2 | 80 | Yes | 0.3 |
| | Acidic | 30 | 30 | 2 | 80 | Yes | 0.3 |
| Inventive Example 17 | Acidic | 30 | 30 | 2 | 80 | Yes | 0.3 |
| Inventive Example 18 | Acidic | 30 | 30 | 2 | 80 | Yes | 0.3 |
| Inventive Example 19 | Acidic | 30 | 30 | 2 | 80 | Yes | 0.3 |
| Inventive Example 20 | Acidic | 30 | 30 | 2 | 80 | Yes | 0.3 |
| Inventive Example 21 | Acidic | 30 | 30 | 2 | 80 | Yes | 0.3 |

TABLE 2-6-continued

| | Coating solution acidic/ neutral/ alkaline | Metal sheet entry temperature into coater (° C.) | Surface treatment metal material temperature (° C.) | Coating film retention time (see) | Maximum reached sheet temperature (° C.) | Co treatment | Composite coating adhesion amount (g/m$^2$) |
|---|---|---|---|---|---|---|---|
| Inventive Example 22 | Acidic | 30 | 30 | 2 | 80 | Yes | 0.3 |
| Inventive Example 23 | Acidic | 30 | 30 | 2 | 80 | Yes | 0.3 |
| Inventive Example 24 | Acidic | 30 | 30 | 2 | 80 | Yes | 0.3 |

TABLE 2-7

| | Coating solution acidic/ neutral/ alkaline | Metal sheet entry temperature into coater (° C.) | Surface treatment metal material temperature (° C.) | Coating film retention time (see) | Maximum reached sheet temperature (° C.) | Co treatment | Composite coating adhesion amount (g/m$^2$) |
|---|---|---|---|---|---|---|---|
| Inventive Example 25 | Acidic | 30 | 30 | 2 | 80 | Yes | 0 3 |
| Inventive Example 26 | Acidic | 30 | 30 | 9 | 80 | Yes | 0.5 |
| Inventive Example 27 | Acidic | 30 | 30 | 2 | 80 | Yes | 0.7 |
| Inventive Example 28 | Acidic | 30 | s0 | 2 | 80 | Yes | 1.0 |
| Inventive Example 29 | Acidic | 30 | 30 | 2 | 80 | Yes | 2.0 |
| Inventive Example 30 | Acidic | 30 | 30 | 2 | 60 | Yes | 0.3 |
| Inventive Example 31 | Acidic | 30 | 30 | 2 | 120 | Yes | 0.3 |
| Inventive Example 32 | Acidic | 30 | 30 | 2 | 150 | Yes | 0.3 |
| Inventive Example 33 | Acidic | 30 | 30 | 2 | 80 | No | 0.3 |
| Inventive Example 34 | Acidic | 30 | 5 | 2 | 80 | Yes | 0.3 |
| Inventive Example 35 | Acidic | 30 | 10 | 2 | 80 | Yes | 0.3 |
| Inventive Example 36 | Acidic | 30 | 15 | 2 | 80 | Yes | 0.3 |
| Inventive Example 37 | Acidic | 30 | 40 | 2 | 80 | Yes | 0.3 |
| Inventive Example 38 | Acidic | 30 | 50 | 9 | 80 | Yes | 0.3 |
| Inventive Example 39 | Acidic | 30 | 60 | 2 | 80 | Yes | 0.3 |
| Inventive Example 40 | Acidic | 5 | 30 | 9 | 80 | Yes | 0.3 |
| Inventive Example 41 | Acidic | 10 | 30 | 2 | 80 | Yes | 0.3 |
| Inventive Example 42 | Acidic | 15 | 30 | 2 | 80 | Yes | 0.3 |
| Inventive Example 43 | Acidic | 40 | 30 | 2 | 80 | Yes | 0.3 |
| Inventive Example 44 | Acidic | 60 | 30 | 2 | 80 | Yes | 0.3 |
| Inventive Example 45 | Acidic | 80 | 30 | 2 | 80 | Yes | 0.3 |
| Comparative Example 27 | Acidic | 90 | 30 | 2 | 80 | Yes | 0.3 |
| Inventive Example 46 | Acidic | 30 | 30 | 10 | 80 | Yes | 0.3 |
| Inventive Example 47 | Acidic | 30 | 30 | 2 | 80 | Yes | 0.3 |
| Inventive Example 48 | Acidic | 30 | 30 | 2 | 80 | Yes | 0.3 |
| Inventive Example 101 | Acidic | 30 | 30 | 2 | 60 | Yes | 0.3 |
| Inventive Example 102 | Acidic | 30 | 30 | 2 | 120 | Yes | 0.3 |
| Inventive Example 49 | Acidic | 30 | 30 | 2 | 80 | Yes | 0.3 |

TABLE 2-8

| | Coating solution acidic/ neutral/ alkaline | Metal sheet entry temperature into coater (° C.) | Surface treatment metal material temperature (° C.) | Coating film retention time (see) | Maximum reached sheet temperature (° C.) | Co treatment | Composite coating adhesion amount (g/m$^2$) |
|---|---|---|---|---|---|---|---|
| Inventive Example 103 | Acidic | 30 | 15 | 2 | 80 | Yes | 0.3 |
| Inventive Example 104 | Acidic | 30 | 40 | 2 | 80 | Yes | 0.3 |
| Inventive Example 50 | Acidic | 30 | 30 | 2 | 80 | Yes | 0.3 |
| Inventive Example 105 | Acidic | 15 | 30 | 2 | 80 | Yes | 0 3 |
| Inventive Example 106 | Acidic | 40 | 30 | 2 | 80 | Yes | 0.3 |
| Comparative Example 25 | Acidic | 30 | 30 | 2 | 80 | Yes | 0.3 |
| Inventive Example 51 | Acidic | 30 | 30 | 2 | 80 | Yes | 0.3 |
| Inventive Example 52 | Acidic | 30 | 30 | 2 | 80 | Yes | 0.3 |
| Inventive Example 53 | Acidic | 30 | 30 | 2 | 80 | Yes | 0.3 |
| Inventive Example 54 | Acidic | 30 | 30 | 2 | 80 | Yes | 0.3 |
| Inventive Example 55 | Acidic | 30 | 30 | 2 | 80 | Yes | 0.3 |
| Inventive Example 110 | Acidic | 30 | 30 | 2 | 80 | Yes | 0.3 |
| Inventive Example 56 | Acidic | 30 | 30 | 2 | 80 | Yes | 0.3 |
| Inventive Example 57 | Acidic | 30 | 30 | 2 | 80 | Yes | 0.3 |
| Inventive Example 58 | Acidic | 30 | 30 | 2 | 80 | Yes | 0.3 |
| Inventive Example 59 | Acidic | 30 | 30 | 2 | 80 | Yes | 0.3 |

TABLE 2-8-continued

| | Coating solution acidic/ neutral/ alkaline | Metal sheet entry temperature into coater (° C.) | Surface treatment metal material temperature (° C.) | Coating film retention time (see) | Maximum reached sheet temperature (° C.) | Co treatment | Composite coating adhesion amount (g/m$^2$) |
|---|---|---|---|---|---|---|---|
| Inventive Example 60 | Acidic | 30 | 30 | 2 | 80 | Yes | 0.3 |
| Inventive Example 61 | Acidic | 30 | 30 | 2 | 80 | Yes | 0.3 |
| Inventive Example 62 | Acidic | 30 | 30 | 2 | 80 | Yes | 0.3 |
| Inventive Example 63 | Acidic | 30 | 30 | 2 | 80 | Yes | 0.3 |
| Inventive Example 64 | Acidic | 30 | 30 | 2 | 80 | Yes | 0.3 |
| Inventive Example 65 | Acidic | 30 | 30 | 2 | 80 | Yes | 0.3 |
| Inventive Example 66 | Acidic | 30 | 30 | 2 | 80 | Yes | 0.3 |
| Inventive Example 67 | Acidic | 30 | 30 | 2 | 80 | Yes | 0.3 |
| Inventive Example 68 | Acidic | 30 | 30 | 2 | 80 | Yes | 0.3 |
| Inventive Example 69 | Acidic | 30 | 30 | 2 | 80 | Yes | 0.3 |
| Inventive Example 70 | Acidic | 30 | 30 | 2 | 80 | Yes | 0.3 |
| Inventive Example 71 | Acidic | 30 | 30 | 2 | 80 | Yes | 0.3 |

TABLE 2-9

| | Coating solution acidic/ neutral/ alkaline | Metal sheet entry temperature into coater (° C.) | Surface treatment metal material temperature (° C.) | Coating film retention time (see) | Maximum reached sheet temperature (° C.) | Co treatment | Composite coating adhesion amount (g/m$^2$) |
|---|---|---|---|---|---|---|---|
| Inventive Example 72 | Acidic | 30 | 30 | 2 | 80 | Yes | 0.3 |
| Inventive Example 73 | Acidic | 30 | 30 | 2 | 80 | Yes | 0.3 |
| Inventive Example 74 | Acidic | 30 | 30 | 2 | 80 | Yes | 0.3 |
| Inventive Example 75 | Acidic | 30 | 30 | 2 | 80 | Yes | 0.3 |
| Inventive Example 76 | Acidic | 30 | 30 | 2 | 80 | Yes | 0.5 |
| Inventive Example 77 | Acidic | 30 | 30 | 2 | 80 | Yes | 0.7 |
| Inventive Example 78 | Acidic | 30 | 30 | 2 | 80 | Yes | 1.0 |
| Inventive Example 79 | Acidic | 30 | 30 | 2 | 80 | Yes | 2.0 |
| Inventive Example 80 | Acidic | 30 | 30 | 2 | 60 | Yes | 0.3 |
| Inventive Example 81 | Acidic | 30 | 30 | 2 | 120 | Yes | 0.3 |
| Inventive Example 82 | Acidic | 30 | 30 | 2 | 150 | Yes | 0.3 |
| Inventive Example 83 | Acidic | 30 | 30 | 2 | 80 | No | 0.3 |
| Inventive Example 84 | Acidic | 30 | 5 | 2 | 80 | Yes | 0.3 |
| Inventive Example 85 | Acidic | 30 | 10 | 2 | 80 | Yes | 0.3 |
| Inventive Example 86 | Acidic | 30 | 15 | 2 | 80 | Yes | 0.3 |
| Inventive Example 87 | Acidic | 30 | 40 | 2 | 80 | Yes | 0.3 |
| inventive Example 88 | Acidic | 30 | 50 | 2 | 80 | Yes | 0.3 |
| Inventive Example 89 | Acidic | 30 | 60 | 2 | 80 | Yes | 0.3 |
| Inventive Example 90 | Acidic | 5 | 30 | 2 | 80 | Yes | 0.3 |
| Inventive Example 91 | Acidic | 10 | 30 | 2 | 80 | Yes | 0.3 |
| Inventive Example 92 | Acidic | 15 | 30 | 2 | 80 | Yes | 0.3 |
| Inventive Example 93 | Acidic | 40 | 30 | 2 | 80 | Yes | 0.3 |
| Inventive Example 94 | Acidic | 60 | 30 | 2 | 80 | Yes | 0.3 |
| Inventive Example 95 | Acidic | 80 | 30 | 2 | 80 | Yes | 0.3 |
| Conspirator Example 28 | Acidic | 90 | 30 | 2 | 80 | Yes | 0.3 |
| | | | | | | Yes | 0.3 |
| Inventive Example 96 | Acidic | 30 | 30 | 10 | 80 | Yes | 0.3 |
| Inventive Example 97 | Acidic | 30 | 50 | 2 | 80 | Yes | 0.3 |
| Inventive Example 98 | Acidic | 30 | 30 | 2 | 80 | Yes | 0.3 |

TABLE 2-10

| | Coating solution acidic/ neutral/ alkaline | Metal sheet entry temperature into coater (° C.) | Surface treatment metal material temperature (° C.) | Coating film retention time (sec) | Maximum reached sheet temperature (° C.) | Co treatment | Composite coating adhesion amount (g/m$^2$) |
|---|---|---|---|---|---|---|---|
| Inventive Example 99 | Acidic | 30 | 30 | 2 | 80 | Yes | 0.3 |
| Inventive Example 100 | Acidic | 30 | 30 | 2 | 80 | Yes | 0.3 |
| Comparative Example 26 | Acidic | 30 | 30 | 2 | 80 | Yes | 0.3 |
| Comparative Example 1 | Acidic | 2.5 | 30 | 2 | 80 | Yes | 0.3 |
| Comparative Example 2 | Acidic | 30 | 30 | 0.25 | 80 | Yes | 0.3 |
| Comparative Example 3 | Acidic | 2.5 | 30 | 2 | 80 | Yes | 0.3 |

TABLE 2-10-continued

| | Coating solution acidic/ neutral/ alkaline | Metal sheet entry temperature into coater (° C.) | Surface treatment metal material temperature (° C.) | Coating film retention time (sec) | Maximum reached sheet temperature (° C.) | Co treatment | Composite coating adhesion amount (g/m$^2$) |
|---|---|---|---|---|---|---|---|
| Comparative Example 4 | Acidic | 30 | 30 | 0.25 | 80 | Yes | 0.3 |
| Comparative Example 5 | Acidic | 2.5 | 30 | 2 | 80 | Yes | 0.3 |
| Comparative Example 6 | Acidic | 30 | 30 | 0.25 | 80 | Yes | 0.3 |
| Comparative Example 7 | Acidic | 2.5 | 30 | 2 | 80 | Yes | 0.3 |
| Comparative Example 8 | Acidic | 30 | 30 | 0.25 | 80 | Yes | 0.3 |
| Comparative Example 9 | Acidic | 2.5 | 30 | 2 | 80 | Yes | 0.3 |
| Comparative Example 10 | Acidic | 30 | 30 | 0.25 | 80 | Yes | 0.3 |
| Comparative Example 21 | Acidic | 2.5 | 30 | 2 | 80 | Yes | 0.3 |
| Comparative Example 22 | Acidic | 30 | 30 | 0.25 | 80 | Yes | 0.3 |
| Comparative Example 11 | Acidic | 2.5 | 30 | 2 | 80 | Yes | 0.3 |
| Comparative Example 12 | Acidic | 30 | 30 | 0.25 | 80 | Yes | 0.3 |
| Comparative Example 13 | Acidic | 2.5 | 30 | 2 | 80 | Yes | 0.3 |
| Comparative Example 14 | Acidic | 30 | 30 | 0.25 | 80 | Yes | 0.3 |
| Comparative Example 15 | Acidic | 2.5 | 30 | 2 | 80 | Yes | 0.3 |
| Comparative Example 16 | Acidic | 30 | 30 | 0.25 | 80 | Yes | 0.3 |
| Comparative Example 17 | Acidic | 2.5 | 30 | 2 | 80 | Yes | 0.3 |
| Comparative Example 18 | Acidic | 30 | 30 | 0.25 | 80 | Yes | 0.3 |
| Comparative Example 19 | Acidic | 2.5 | 30 | 2 | 80 | Yes | 0.3 |
| Comparative Example 20 | Acidic | 30 | 30 | 0.25 | 80 | Yes | 0.3 |
| Comparative Example 23 | Acidic | 2.5 | 30 | 2 | 80 | Yes | 0.3 |
| Comparative Example 24 | Acidic | 30 | 30 | 0.25 | 80 | Yes | 0.3 |

TABLE 3-1

| | Composite coating | | | | | | Corrosion resistance in salt spray test | | |
|---|---|---|---|---|---|---|---|---|---|
| | Maximum value of V/Zn | Area ratio of V concentrated region | Maximum value of V/Si | Average value of (Zr + Ti)/Si | Average value of P/Si | Average value of V/Si | N1 | N2 | N3 |
| Inventive Example 1 | 0.014 | 8 | 28.7 | 0.08 | 0.18 | 0.07 | 4 | 3 | 3 |
| Inventive Example 2 | 0.093 | 10 | 10.0 | 0.06 | 0.16 | 0.10 | 4 | 4 | 4 |
| Inventive Example 3 | 0.082 | 16 | 24.7 | 0.13 | 0.17 | 0.02 | 3 | 4 | 4 |
| Inventive Example 4 | 0.065 | 12 | 59.6 | 0.11 | 0.19 | 0.08 | 3 | 4 | 4 |
| Inventive Example 5 | 0.048 | 3 | 21.5 | 0.15 | 0.23 | 0.04 | 4 | 4 | 4 |
| Inventive Example 111 | 0.053 | 4 | 19.5 | 0.13 | 0.22 | 0.04 | 4 | 4 | 4 |
| Inventive Example 109 | 0.040 | 7 | 22.0 | 0.14 | 0.23 | 0.05 | 4 | 4 | 4 |
| Inventive Example 107 | 0.050 | 3 | 20.7 | 0.14 | 0.16 | 0.02 | 4 | 4 | 3 |
| Inventive Example 108 | 0.051 | 3 | 20.8 | 0.11 | 0.20 | 0.06 | 4 | 3 | 4 |
| Inventive Example 6 | 0.044 | 2 | 20.1 | 0.09 | 0.20 | 0.01 | 4 | 3 | 3 |
| Inventive Example 7 | 0.040 | 19 | 11.6 | 0.12 | 0.24 | 0.03 | 4 | 4 | 3 |
| Inventive Example 8 | 0.046 | 6 | 1.8 | 0.07 | 0.15 | 0.05 | 4 | 4 | 4 |
| Inventive Example 9 | 0.089 | 9 | 8.7 | 0.14 | 0.21 | 0.09 | 4 | 3 | 4 |
| Inventive Example 10 | 0.020 | 7 | 11.4 | 0.10 | 0.25 | 0.06 | 3 | 4 | 4 |
| Inventive Example 11 | 0.051 | 15 | 20.2 | 0.10 | 0.22 | 0.09 | 4 | 4 | 4 |
| Inventive Example 12 | 0.094 | 14 | 5.6 | 0.06 | 0.18 | 0.07 | 4 | 3 | 4 |
| Inventive Example 13 | 0.084 | 18 | 9.4 | 0.08 | 0.23 | 0.02 | 3 | 4 | 3 |
| Inventive Example 14 | 0.050 | 17 | 23.8 | 0.09 | 0.16 | 0.04 | 4 | 4 | 4 |
| Inventive Example 15 | 0.049 | 4 | 29.2 | 0.15 | 0.24 | 0.01 | 3 | 3 | 4 |
| Inventive Example 16 | 0.064 | 20 | 19.7 | 0.05 | 0.15 | 0.03 | 3 | 3 | 3 |
| Inventive Example 17 | 0.023 | 5 | 27.1 | 0.11 | 0.14 | 0.08 | 3 | 3 | 4 |
| Inventive Example 18 | 0.030 | 11 | 16.3 | 0.07 | 0.20 | 0.06 | 4 | 3 | 4 |
| Inventive Example 19 | 0.040 | 13 | 46.2 | 0.13 | 0.27 | 0.10 | 4 | 3 | 3 |
| Inventive Example 20 | 0.052 | 1 | 26.5 | 0.17 | 0.17 | 0.05 | 4 | 3 | 4 |
| Inventive Example 21 | 0.014 | 14 | 14.6 | 0.07 | 0.22 | 0.05 | 3 | 3 | 4 |
| Inventive Example 22 | 0.076 | 20 | 20.8 | 0.09 | 0.19 | 0.01 | 3 | 4 | 3 |
| Inventive Example 23 | 0.085 | 13 | 4.2 | 0.13 | 0.21 | 0.03 | 4 | 4 | 3 |
| Inventive Example 24 | 0.015 | 19 | 7.5 | 0.08 | 0.22 | 0.05 | 3 | 4 | 3 |

TABLE 3-2

| | Composite coating | | | | | | Corrosion resistance in salt spray test | | |
|---|---|---|---|---|---|---|---|---|---|
| | Maximum value of V/Zn | Area ratio of V concentrated region | Maximum value of V/Si | Average value of (Zr + Ti)/Si | Average value of P/Si | Average value of V/Si | N1 | N2 | N3 |
| Inventive Example 25 | 0.028 | 15 | 8.4 | 0.11 | 0.20 | 0.17 | 3 | 3 | 4 |
| Inventive Example 26 | 0.067 | 10 | 23.7 | 0.15 | 0.17 | 0.06 | 4 | 4 | 4 |
| Inventive Example 27 | 0.012 | 18 | 19.0 | 0.06 | 0.19 | 0.09 | 4 | 4 | 4 |
| Inventive Example 28 | 0.017 | 6 | 17.5 | 0.10 | 0.24 | 0.02 | 4 | 4 | 4 |
| Inventive Example 29 | 0.029 | 17 | 5.1 | 0.14 | 0.23 | 0.10 | 4 | 4 | 4 |
| Inventive Example 30 | 0.037 | 8 | 7.0 | 0.12 | 0.25 | 0.07 | 3 | 4 | 4 |
| Inventive Example 31 | 0.096 | 11 | 20.5 | 0.08 | 0.15 | 0.08 | 4 | 4 | 4 |
| Inventive Example 32 | 0.021 | 16 | 18.6 | 0.11 | 0.18 | 0.05 | 4 | 4 | 4 |
| Inventive Example 33 | 0.084 | 2 | 17.8 | 0.14 | 0.16 | 0.10 | 4 | 4 | 3 |
| Inventive Example 34 | 0.072 | 30 | 1.8 | 0.12 | 0.22 | 0.07 | 3 | 3 | 3 |
| Inventive Example 35 | 0.066 | 29 | 2.7 | 0.06 | 0.18 | 0.03 | 3 | 3 | 4 |
| Inventive Example 36 | 0.023 | 3 | 2.4 | 0.09 | 0.25 | 0.06 | 4 | 4 | 4 |
| Inventive Example 37 | 0.013 | 4 | 3.3 | 0.13 | 0.20 | 0.02 | 4 | 3 | 4 |
| Inventive Example 38 | 0.077 | 12 | 14.1 | 0.15 | 0.17 | 0.04 | 3 | 4 | 4 |
| Inventive Example 39 | 0.017 | 5 | 14.7 | 0.07 | 0.16 | 0.09 | 4 | 4 | 3 |
| Inventive Example 40 | 0.075 | 37 | 1.1 | 0.10 | 0.23 | 0.01 | 3 | 3 | 3 |
| Inventive Example 41 | 0.064 | 36 | 2.9 | 0.06 | 0.15 | 0.01 | 4 | 3 | 3 |
| Inventive Example 42 | 0.049 | 19 | 22.5 | 0.10 | 0.24 | 0.10 | 3 | 3 | 3 |
| Inventive Example 43 | 0.062 | 7 | 24.9 | 0.09 | 0.19 | 0.03 | 3 | 4 | 4 |
| Inventive Example 44 | 0.022 | 9 | 1.7 | 0.12 | 0.21 | 0.05 | 4 | 3 | 3 |
| Inventive Example 45 | 0.080 | 16 | 68.0 | 0.08 | 0.19 | 0.04 | 3 | 4 | 3 |
| Comparative Example 27 | 0.150 | 0.4 | 116 0 | 0.06 | 0.16 | 0.07 | 3 | 3 | 2 |
| Inventive Example 46 | 0.077 | 6 | 86.0 | 0.14 | 0.18 | 0.07 | 3 | 3 | 3 |
| Inventive Example 47 | 0.056 | 1 | 34.1 | 0.13 | 0.23 | 0.08 | 3 | 3 | 3 |
| Inventive Example 48 | 0.076 | 8 | 3.0 | 0.07 | 0.24 | 0.02 | 4 | 4 | 4 |
| Inventive Example 101 | 0.077 | 5 | 47.3 | 0.08 | 0.22 | 0.03 | 4 | 3 | 4 |
| Inventive Example 102 | 0.099 | 11 | 21.5 | 0.08 | 0.19 | 0.04 | 3 | 4 | 4 |
| Inventive Example 49 | 0.069 | 12 | 12.4 | 0.15 | 0.21 | 0.09 | 4 | 4 | 4 |

TABLE 3-3

| | Composite coating | | | | | | Corrosion resistance in salt spray test | | |
|---|---|---|---|---|---|---|---|---|---|
| | Maximum value of V/Zn | Area ratio of V concentrated region | Maximum value of V/Si | Average value of (Zr + Ti)/Si | Average value of P/Si | Average value of V/Si | N1 | N2 | N3 |
| Inventive Example 103 | 0.090 | 3 | 9.9 | 0.14 | 0.23 | 0.06 | 4 | 4 | 3 |
| Inventive Example 104 | 0.047 | 10 | 19.8 | 0.07 | 0.23 | 0.10 | 4 | 3 | 4 |
| Inventive Example 50 | 0.016 | 18 | 26.2 | 0.11 | 0.25 | 0.06 | 4 | 4 | 4 |
| Inventive Example 105 | 0.087 | 2 | 1.0 | 0.13 | 0.20 | 0.08 | 3 | 4 | 4 |
| Inventive Example 106 | 0.018 | 15 | 49.9 | 0.09 | 0.24 | 0.09 | 4 | 4 | 3 |
| Comparative Example 25 | 0.002 | 69 | 0.7 | 0.06 | 0.17 | 0.04 | 2 | 3 | 2 |
| Inventive Example 51 | 0.053 | 13 | 26.7 | 0.09 | 0.16 | 0.09 | 4 | 3 | 4 |
| Inventive Example 52 | 0.070 | 14 | 6.3 | 0.07 | 0.15 | 0.06 | 4 | 4 | 4 |
| Inventive Example 53 | 0.053 | 17 | 24.1 | 0.14 | 0.20 | 0.10 | 3 | 4 | 4 |
| Inventive Example 54 | 0.059 | 20 | 25.8 | 0.11 | 0.17 | 0.07 | 4 | 4 | 3 |
| Inventive Example 55 | 0.090 | 6 | 3.6 | 0.08 | 0.22 | 0.01 | 4 | 4 | 4 |
| Inventive Example 110 | 0.039 | 8 | 19.0 | 0.12 | 0.25 | 0.07 | 4 | 4 | 4 |
| Inventive Example 56 | 0.025 | 16 | 74.3 | 0.06 | 0.23 | 0.02 | 3 | 4 | 3 |
| Inventive Example 57 | 0.097 | 7 | 11.5 | 0.10 | 0.21 | 0.08 | 4 | 4 | 3 |
| Inventive Example 58 | 0.040 | 2 | 13.5 | 0.13 | 0.18 | 0.05 | 4 | 4 | 4 |
| Inventive Example 59 | 0.092 | 1 | 25.0 | 0.15 | 0.15 | 0.03 | 3 | 4 | 4 |
| Inventive Example 60 | 0.055 | 18 | 16.7 | 0.12 | 0.17 | 0.04 | 4 | 3 | 4 |
| Inventive Example 61 | 0.091 | 15 | 5.2 | 0.09 | 0.19 | 0.06 | 4 | 4 | 4 |
| Inventive Example 62 | 0.046 | 4 | 15.9 | 0.14 | 0.20 | 0.02 | 4 | 3 | 4 |
| Inventive Example 63 | 0.031 | 19 | 16.2 | 0.12 | 0.16 | 0.10 | 4 | 4 | 4 |
| Inventive Example 64 | 0.027 | 14 | 10.1 | 0.08 | 0.22 | 0.04 | 3 | 3 | 4 |
| Inventive Example 65 | 0.090 | 17 | 28.4 | 0.10 | 0.24 | 0.09 | 3 | 4 | 4 |
| Inventive Example 66 | 0.051 | 5 | 8.5 | 0.04 | 0.25 | 0.03 | 3 | 4 | 3 |
| Inventive Example 67 | 0.061 | 9 | 23.4 | 0.06 | 0.13 | 0.08 | 3 | 3 | 3 |
| Inventive Example 68 | 0.051 | 10 | 4.0 | 0.11 | 0.16 | 0.07 | 3 | 4 | 4 |
| Inventive Example 69 | 0.063 | 11 | 10.4 | 0.13 | 0.26 | 0.05 | 3 | 4 | 3 |
| Inventive Example 70 | 0.013 | 13 | 12.2 | 0.20 | 0.21 | 0.01 | 3 | 3 | 4 |
| Inventive Example 71 | 0.055 | 8 | 18.5 | 0.12 | 0.24 | 0.07 | 4 | 4 | 3 |

TABLE 3-4

| | Composite coating | | | | | | Corrosion resistance in salt spray test | | |
|---|---|---|---|---|---|---|---|---|---|
| | Maximum value of V/Zn | Area ratio of V concentrated region | Maximum value of V/Si | Average value of (Zr + Ti)/Si | Average value of P/Si | Average value of V/Si | N1 | N2 | N3 |
| Inventive Example 72 | 0.099 | 12 | 22.7 | 0.15 | 0.18 | 0.01 | 4 | 3 | 3 |
| Inventive Example 73 | 0.038 | 3 | 15.4 | 0.10 | 0.17 | 0.02 | 4 | 4 | 4 |
| Inventive Example 74 | 0.035 | 20 | 9.0 | 0.06 | 0.20 | 0.05 | 4 | 4 | 4 |
| Inventive Example 75 | 0.085 | 1 | 12.8 | 0.09 | 0.15 | 0.15 | 3 | 3 | 4 |
| Inventive Example 76 | 0.097 | 2 | 9.1 | 0.07 | 0.22 | 0.09 | 4 | 4 | 4 |
| Inventive Example 77 | 0.073 | 14 | 97.3 | 0.14 | 0.19 | 0.01 | 3 | 4 | 4 |
| Inventive Example 78 | 0.084 | 13 | 5.9 | 0.11 | 0.15 | 0.02 | 4 | 4 | 4 |
| Inventive Example 79 | 0.063 | 19 | 3.9 | 0.08 | 0.17 | 0.04 | 4 | 3 | 4 |
| Inventive Example 80 | 0.066 | 7 | 28.3 | 0.13 | 0.25 | 0.06 | 4 | 3 | 4 |
| Inventive Example 81 | 0.055 | 18 | 5.8 | 0.12 | 0.20 | 0.10 | 4 | 4 | 4 |
| Inventive Example 82 | 0.019 | 20 | 22.6 | 0.06 | 0.23 | 0.08 | 4 | 4 | 4 |
| Inventive Example 83 | 0.040 | 4 | 3.2 | 0.14 | 0.21 | 0.09 | 4 | 4 | 4 |
| Inventive Example 84 | 0.082 | 45 | 1.3 | 0.11 | 0.22 | 0.02 | 3 | 3 | 3 |
| Inventive Example 85 | 0.028 | 39 | 2.8 | 0.13 | 0.16 | 0.06 | 4 | 3 | 3 |
| Inventive Example 86 | 0.032 | 11 | 7.2 | 0.15 | 0.19 | 0.05 | 4 | 4 | 4 |
| Inventive Example 87 | 0.043 | 5 | 7.7 | 0.09 | 0.24 | 0.04 | 4 | 3 | 4 |
| Inventive Example 88 | 0.097 | 3 | 2.2 | 0.08 | 0.18 | 0.03 | 4 | 3 | 3 |
| Inventive Example 89 | 0.011 | 16 | 5.0 | 0.10 | 0.18 | 0.01 | 4 | 3 | 3 |
| Inventive Example 90 | 0.067 | 25 | 1.4 | 0.07 | 0.15 | 0.07 | 3 | 3 | 3 |
| Inventive Example 91 | 0.088 | 40 | 2.4 | 0.08 | 0.25 | 0.02 | 3 | 4 | 3 |
| Inventive Example 92 | 0.068 | 12 | 14.9 | 0.06 | 0.23 | 0.10 | 4 | 4 | 4 |
| Inventive Example 93 | 0.021 | 17 | 21.9 | 0.09 | 0.22 | 0.05 | 4 | 4 | 3 |
| Inventive Example 94 | 0.083 | 15 | 69.6 | 0.14 | 0.20 | 0.09 | 4 | 4 | 4 |
| Inventive Example 95 | 0.019 | 10 | 61.0 | 0.07 | 0.25 | 0.02 | 3 | 4 | 3 |
| Comparative Example 28 | 0.120 | 0 | 110.0 | 0.14 | 0.23 | 0.02 | 2 | 3 | 3 |
| Inventive Example 96 | 0.056 | 17 | 79.1 | 0.10 | 0.17 | 0.05 | 3 | 3 | 3 |
| Inventive Example 97 | 0.029 | 11 | 58.9 | 0.13 | 0.17 | 0.08 | 3 | 3 | 3 |
| Inventive Example 98 | 0.051 | 3 | 55.4 | 0.10 | 0.17 | 0.03 | 4 | 4 | 4 |

TABLE 3-5

| | Composite coating | | | | | | Corrosion resistance in salt spray test | | |
|---|---|---|---|---|---|---|---|---|---|
| | Maximum value of V/Zn | Area ratio of V concentrated region | Maximum value of V/Si | Average value of (Zr + Ti)/Si | Average value of P/Si | Average value of V/Si | N1 | N2 | N3 |
| Inventive Example 99 | 0.015 | 6 | 45.7 | 0.11 | 0.20 | 0.09 | 4 | 4 | 4 |
| Inventive Example 100 | 0.031 | 13 | 40.8 | 0.14 | 0.21 | 0.08 | 4 | 4 | 4 |
| Comparative Example 26 | 0.009 | 61 | 0.7 | 0.11 | 0.16 | 0.04 | 2 | 3 | 2 |
| Comparative Example 1 | 0.005 | 73 | 0.6 | 0.10 | 0.17 | 0.21 | 1 | 2 | 2 |
| Comparative Example 2 | 0.004 | 67 | 0.6 | 0.13 | 0.22 | 0.19 | 2 | 2 | 2 |
| Comparative Example 3 | 0.005 | 68 | 0.9 | 0.15 | 0.20 | 0.25 | 2 | 3 | 2 |
| Comparative Example 4 | 0.008 | 59 | 0.3 | 0.09 | 0.25 | 0.18 | 3 | 3 | 2 |
| Comparative Example 5 | 0.005 | 72 | 0.6 | 0.08 | 0.24 | 0.22 | 2 | 3 | 3 |
| Comparative Example 6 | 0.004 | 64 | 0.5 | 0.12 | 0.19 | 0.17 | 3 | 2 | 2 |
| Comparative Example 7 | 0.000 | 70 | 0.2 | 0.06 | 0.21 | 0.14 | 2 | 2 | 3 |
| Comparative Example 8 | 0.003 | 63 | 0.2 | 0.11 | 0.18 | 0.13 | 3 | 2 | 3 |
| Comparative Example 9 | 0.008 | 76 | 0.2 | 0.07 | 0.23 | 0.16 | 2 | 3 | 2 |
| Comparative Example 10 | 0.008 | 65 | 0.7 | 0.14 | 0.16 | 0.21 | 2 | 2 | 3 |
| Comparative Example 21 | 0.006 | 66 | 0.9 | 0.11 | 0.18 | 0.07 | 1 | 2 | 2 |
| Comparative Example 22 | 0.009 | 71 | 0.5 | 0.07 | 0.25 | 0.03 | 2 | 2 | 1 |

TABLE 3-5-continued

| | Composite coating | | | | | | Corrosion resistance in salt spray test | | |
|---|---|---|---|---|---|---|---|---|---|
| | Maximum value of V/Zn | Area ratio of V concentrated region | Maximum value of V/Si | Average value of (Zr + Ti)/Si | Average value of P/Si | Average value of V/Si | N1 | N2 | N3 |
| Comparative Example 11 | 0.004 | 75 | 0.6 | 0.07 | 0.15 | 0.15 | 2 | 1 | 2 |
| Comparative Example 12 | 0.009 | 62 | 0.7 | 0.08 | 0.25 | 0.23 | 2 | 2 | 2 |
| Comparative Example 13 | 0.003 | 60 | 0.5 | 0.09 | 0.22 | 0.12 | 3 | 3 | 2 |
| Comparative Example 14 | 0.005 | 77 | 0.5 | 0.10 | 0.18 | 0.24 | 3 | 3 | 2 |
| Comparative Example 15 | 0.006 | 56 | 0.8 | 0.13 | 0.24 | 0.17 | 3 | 2 | 2 |
| Comparative Example 16 | 0.003 | 55 | 0.3 | 0.06 | 0.15 | 0.19 | 2 | 3 | 3 |
| Comparative Example 17 | 0.003 | 79 | 0.5 | 0.11 | 0.23 | 0.18 | 3 | 2 | 3 |
| Comparative Example 18 | 0.001 | 74 | 0.6 | 0.15 | 0.17 | 0.13 | 3 | 2 | 3 |
| Comparative Example 19 | 0.007 | 78 | 0.4 | 0.12 | 0.16 | 0.12 | 3 | 3 | 2 |
| Comparative Example 20 | 0.007 | 57 | 0.5 | 0.14 | 0.21 | 0.25 | 3 | 1 | 3 |
| Comparative Example 23 | 0.003 | 80 | 0.3 | 0.09 | 0.20 | 0.04 | 2 | 1 | 2 |
| Comparative Example 24 | 0.009 | 58 | 0.8 | 0.14 | 0.17 | 0.08 | 2 | 2 | 1 |

As can be seen from Tables 1 to 3-5, in the inventive examples, the composite coating was in a preferable state, and the corrosion resistance of the three arbitrarily collected samples had a score of 3 or higher.

Further, although not shown in the tables, the inventive examples were also excellent in heat resistance, fingerprint resistance, conductivity, coatability, and black doposit resistance during processing.

On the other hand, in the comparative examples, the maximum value of V/Zn was not within the range of the present invention, and the corrosion resistance was decreased.

Example 2

A surface treatment metal agent was applied to the metal sheet M2 among the metal sheets used in Example 1.

However, in Example 2, after plating, the plating was retained at the humidity and the retention time shown in Tables 4-1 to 4-6, and the time from completion of plating to coating was controlled as shown in Tables 4-1 to 4-6. The temperature changes of the plating layer during the time from the completion of plating to the coating are shown in Tables 4-1 to 4-6.

Regarding conditions other than those indicated above, a surface treatment metal agent containing an organic silicon compound, one or two of a zirconium compound and a titanium compound, a phosphoric acid compound, a fluorine compound, and a vanadium compound, as shown in Tables 4-1 to 4-6, and having an adjusted temperature was applied as a coating liquid to a metal material having a plating layer of M2 appropriately heated to a metal sheet entry sheet temperature shown in Tables 4-1 to 4-6 using a roll coater without degreasing after plating. When the surface treatment metal agent was applied onto the plating layer, Co-treatment was performed for some examples.

Thereafter, the metal sheet was washed with water for 10 seconds using a spray.

The viscosity of the surface treatment metal agent in each example at 25° C. was in the range of 1 to 2 mPa-s.

Further, in the tables, in the "silane coupling agent" of the organic silicon compound, A1, A2, B1 and B2 indicate the following.

A1: 3-aminopropyltrimethoxysilane

A2: 3-aminopropyltriethoxysilane

B1: 3-glycidoxypropyltrimethoxysilane

B2: 3-glycidoxypropyltriethoxysilane

Further, in the V compound, Z1 and Z2 indicate the following.

Z1: vanadium oxysulfate $VOSO_4$,

Z2: vanadium oxyacetylacetonate $VO(OC(=CH_2)CH_2COCH_3)_2$.

After applying the surface treatment metal agent and allowing the coating film retention time in Tables 4-1 to 4-6 to elapse, the metal material to which the surface treatment metal agent was applied was heated to the maximum reached sheet temperatures of Tables 4-1 to 4-6, dried, and baked. The surface-treated metal material was retained in the atmosphere described in Tables 4-1 to 4-6. The coating film retention time was adjusted by controlling the transfer speed of the steel sheet from the roll coater to the heating furnace.

TABLE 4-1

| | Base material | Organic silicon compound (W) Silane coupling agent A | B | Ratio A/B | Molecular weight | Fluorine compound (X1), zirconium compound or titanium compound (X2) Type | Ratio X/W | Phosphoric acid compound (Y) Type Phosphoric acid | Ratio Y/W | V compound (Z) Type | Ratio Z/W | Coating solution Acidic/neutral/alkaline |
|---|---|---|---|---|---|---|---|---|---|---|---|---|
| Inventive Example 5-1 | M-2 | A2 | B1 | 1.0 | 3000 | $TiF_6^{2-}$ | 0.10 | Phosphoric acid | 0.20 | Z1 | 0.075 | Acidic |
| Inventive Example 5-2 | M-2 | A2 | B1 | 1.0 | 3000 | $TiF_6^{2-}$ | 0.10 | Phosphoric acid | 0.20 | Z1 | 0.075 | Acidic |
| Inventive Example 5-3 | M-2 | A2 | B1 | 1.0 | 3000 | $ZrF_6^{2-}$ | 0.10 | Phosphoric acid | 0.20 | Z1 | 0.075 | Acidic |
| Inventive Example 5-4 | M-2 | A2 | B1 | 1.0 | 3000 | $TiF_6^{2-}$ | 0.10 | Phosphoric acid | 0.20 | Z1 | 0.075 | Acidic |
| Inventive Example 5-5 | M-2 | A2 | B1 | 1.0 | 3000 | $TiF_6^{2-}$ | 0.10 | Phosphoric acid | 0.20 | Z1 | 0.075 | Acidic |
| Inventive Example 5-6 | M-2 | A2 | B1 | 1.0 | 3000 | $ZrF_6^{2-}$ | 0.10 | Phosphoric acid | 0.20 | Z1 | 0.075 | Acidic |
| Inventive Example 5-7 | M-2 | A2 | B1 | 1.0 | 3000 | $ZrF_6^{2-}$ | 0.10 | Phosphoric acid | 0.20 | Z1 | 0.075 | Acidic |
| Inventive Example 5-8 | M-2 | A2 | B1 | 1 0 | 3000 | $TiF_6^{2-}$ | 0.10 | Phosphoric acid | 0.20 | Z1 | 0.075 | Acidic |
| Inventive Example 5-9 | M-2 | A2 | B1 | 1.0 | 3000 | $ZrF_6^{2-}$ | 0.10 | Phosphoric acid | 0.20 | Z1 | 0.075 | Acidic |
| Inventive Example 5-10 | M-2 | A2 | B1 | 1 0 | 3000 | $TiF_6^{2-}$ | 0.10 | Phosphoric acid | 0.20 | Z1 | 0.075 | Acidic |
| Inventive Example 5-11 | M-2 | A2 | B1 | 1 0 | 3000 | $TiF_6^{2-}$ | 0.10 | Phosphoric acid | 0.20 | Z1 | 0.075 | Acidic |
| Inventive Example 5-12 | M-2 | A2 | B1 | 10 | 3000 | $ZrF_6^{2-}$ | 0.10 | Phosphoric acid | 0.20 | Z1 | 0.075 | Acidic |
| Inventive Example 5-13 | M-2 | A2 | B1 | 1.0 | 3000 | $ZrF_6^{2-}$ | 0.10 | Phosphoric acid | 0.20 | Z1 | 0.075 | Acidic |
| Inventive Example 5-14 | M-2 | A2 | B1 | 1.0 | 3000 | $ZrF_6^{2-}$ | 0.10 | Phosphoric acid | 0.20 | Z1 | 0.075 | Acidic |
| Inventive Example 5-15 | M-2 | A2 | B1 | 1.0 | 3000 | $TiF_6^{2-}$ | 0.10 | Phosphoric acid | 0.20 | Z1 | 0.075 | Acidic |
| Inventive Example 5-16 | M-2 | A2 | B1 | 1 0 | 3000 | $TiF_6^{2-}$ | 0.10 | Phosphoric acid | 0.20 | Z1 | 0.075 | Acidic |
| Inventive Example 5-17 | M-2 | A2 | B1 | 1.0 | 3000 | $TiF_6^{2-}$ | 0.10 | Phosphoric acid | 0.20 | Z1 | 0.075 | Acidic |
| Inventive Example 5-18 | M-2 | A2 | B1 | 1.0 | 3000 | $TiF_6^{2-}$ | 0.10 | Phosphoric acid | 0.20 | Z1 | 0.075 | Acidic |
| Inventive Example 5-19 | M-2 | A2 | B1 | 1 0 | 3000 | $ZrF_6^{2-}$ | 0.10 | Phosphoric acid | 0.20 | Z1 | 0.075 | Acidic |

TABLE 4-2

| | Base material | Organic silicon compound (W) Silane coupling agent A | B | Ratio A/B | Molecular weight | Fluorine compound (X1), zirconium compound or titanium compound (X2) Type | Ratio X/W | Phosphoric acid compound (Y) Type Phosphoric acid | Ratio Y/W | V compound (Z) Type | Ratio Z/W | Coating solution Acidic/neutral/alkaline |
|---|---|---|---|---|---|---|---|---|---|---|---|---|
| Inventive Example 5-20 | M-2 | A2 | B1 | 1.0 | 3000 | $ZrF_6^{2-}$ | 0.10 | Phosphoric acid | 0.20 | Z1 | 0.075 | Acidic |
| Inventive Example 5-21 | M-2 | A2 | B1 | 1.0 | 3000 | $TiF_6^{2-}$ | 0.10 | Phosphoric acid | 0.20 | Z1 | 0.075 | Acidic |
| Inventive Example 5-22 | M-2 | A2 | B1 | 1.0 | 3000 | $TiF_6^{2-}$ | 0.10 | Phosphoric acid | 0.20 | Z1 | 0.075 | Acidic |
| Inventive Example 5-23 | M-2 | A2 | B1 | 1.0 | 3000 | $ZrF_6^{2-}$ | 0.10 | Phosphoric acid | 0.20 | Z1 | 0.075 | Acidic |
| Inventive Example 5-24 | M-2 | A2 | B1 | 1.0 | 3000 | $TiF_6^{2-}$ | 0.10 | Phosphoric acid | 0.20 | Z1 | 0.075 | Acidic |
| Inventive Example 5-25 | M-2 | A2 | B1 | 1.0 | 3000 | $ZrF_6^{2-}$ | 0.10 | Phosphoric acid | 0.20 | Z1 | 0.075 | Acidic |
| Inventive Example 5-26 | M-2 | A2 | B1 | 1.0 | 3000 | $ZrF_6^{2-}$ | 0.10 | Phosphoric acid | 0.20 | Z1 | 0.075 | Acidic |
| Inventive Example 5-27 | M-2 | A2 | B1 | 1.0 | 3000 | $TiF_6^{2-}$ | 0.10 | Phosphoric acid | 0.20 | Z1 | 0.075 | Acidic |
| Inventive Example 55-1 | M-2 | A2 | B1 | 1.0 | 3000 | $ZrF_6^{2-}$ | 0.10 | Phosphoric acid | 0.20 | Z1 | 0.075 | Acidic |
| Inventive Example 55-2 | M-2 | A2 | B1 | 1.0 | 3000 | $ZrF_6^{2-}$ | 0.10 | Phosphoric acid | 0.20 | Z1 | 0.075 | Acidic |
| Inventive Example 55-3 | M-2 | A2 | B1 | 1.0 | 3000 | $ZrF_6^{2-}$ | 0.10 | Phosphoric acid | 0.20 | Z1 | 0.075 | Acidic |
| Inventive Example 55-4 | M-2 | A2 | B1 | 1.0 | 3000 | $ZrF_6^{2-}$ | 0.10 | Phosphoric acid | 0.20 | Z1 | 0.075 | Acidic |
| Inventive Example 55-5 | M-2 | A2 | B1 | 1.0 | 3000 | $ZrF_6^{2-}$ | 0.10 | Phosphoric acid | 0.20 | Z1 | 0.075 | Acidic |
| Inventive Example 55-6 | M-2 | A2 | B1 | 1.0 | 3000 | $TiF_6^{2-}$ | 0.10 | Phosphoric acid | 0.20 | Z1 | 0.075 | Acidic |
| Inventive Example 55-7 | M-2 | A2 | B1 | 1.0 | 3000 | $TiF_6^{2-}$ | 0.10 | Phosphoric acid | 0.20 | Z1 | 0.075 | Acidic |
| Inventive Example 55-8 | M-2 | A2 | B1 | 1.0 | 3000 | $ZrF_6^{2-}$ | 0.10 | Phosphoric acid | 0.20 | Z1 | 0 075 | Acidic |
| Inventive Example 55-9 | M-2 | A2 | B1 | 1.0 | 3000 | $TiF_6^{2-}$ | 0.10 | Phosphoric acid | 0.20 | Z1 | 0.075 | Acidic |
| Inventive Example 55-10 | M-2 | A2 | B1 | 1.0 | 3000 | $TiF_6^{2-}$ | 0.10 | Phosphoric acid | 0.20 | Z1 | 0.075 | Acidic |
| Inventive Example 55-11 | M-2 | A2 | B1 | 1.0 | 3000 | $ZrF_6^{2-}$ | 0.10 | Phosphoric acid | 0.20 | Z1 | 0.075 | Acidic |

TABLE 4-3

| | Base material | Organic silicon compound (W) Silane coupling agent A | B | Ratio A/B | Molecular weight | Fluorine compound (X1), zirconium compound or titanium compound (X2) Type | Ratio X/W | Phosphoric acid compound (Y) Type | Ratio Y/W | V compound (Z) Type | Ratio Z/W | Coating solution Acidic/neutral/alkaline |
|---|---|---|---|---|---|---|---|---|---|---|---|---|
| Inventive Example 55-12 | M-2 | A2 | B1 | 1.0 | 3000 | $TiF_6^{2-}$ | 0.10 | Phosphoric acid | 0.20 | Z1 | 0.075 | Acidic |
| Inventive Example 55-13 | M-2 | A2 | B1 | 1.0 | 3000 | $TiF_6^{2-}$ | 0.10 | Phosphoric acid | 0.20 | Z1 | 0.075 | Acidic |
| Inventive Example 55-14 | M-2 | A2 | B1 | 1.0 | 3000 | $TiF_6^{2-}$ | 0.10 | Phosphoric acid | 0.20 | Z1 | 0.075 | Acidic |
| Inventive Example 55-15 | M-2 | A2 | B1 | 1.0 | 3000 | $TiF_6^{2-}$ | 0.10 | Phosphoric acid | 0.20 | Z1 | 0.075 | Acidic |
| Inventive Example 55-16 | M-2 | A2 | B1 | 1.0 | 3000 | $TiF_6^{2-}$ | 0.10 | Phosphoric acid | 0.20 | Z1 | 0.075 | Acidic |
| Inventive Example 55-17 | M-2 | A2 | B1 | 1.0 | 3000 | $TiF_6^{2-}$ | 0.10 | Phosphoric acid | 0.20 | Z1 | 0.075 | Acidic |
| Inventive Example 55-18 | M-2 | A2 | B1 | 1.0 | 3000 | $ZrF_6^{2-}$ | 0.10 | Phosphoric acid | 0.20 | Z1 | 0.075 | Acidic |
| Inventive Example 55-19 | M-2 | A2 | B1 | 1.0 | 3000 | $ZrF_6^{2-}$ | o.10 | Phosphoric acid | 0.20 | Z1 | 0.075 | Acidic |
| Inventive Example 55-20 | M-2 | A2 | B1 | 1.0 | 3000 | $ZrF_6^{2-}$ | 0.10 | Phosphoric acid | 0.20 | Z1 | 0.075 | Acidic |
| Inventive Example 55-21 | M-2 | A2 | B1 | 1.0 | 3000 | $ZrF_6^{2-}$ | o.10 | Phosphoric acid | 0.20 | Z1 | 0.075 | Acidic |
| Inventive Example 55-22 | M-2 | A2 | B1 | 1.0 | 3000 | $ZrF_6^{2-}$ | 0,10 | Phosphoric acid | 0.20 | Z1 | 0.075 | Acidic |
| Inventive Example 55-23 | M-2 | A2 | B1 | 1.0 | 3000 | $ZrF_6^{2-}$ | 0.10 | Phosphoric acid | 0.20 | Z1 | 0.075 | Acidic |
| Inventive Example 55-24 | M-2 | A2 | B1 | 1.0 | 3000 | $TiF_6^{2-}$ | 0.10 | Phosphoric acid | 0.20 | Z1 | 0.075 | Acidic |
| Inventive Example 55-25 | M-2 | A2 | B1 | 1.0 | 3000 | $ZrF_6^{2-}$ | 0.10 | Phosphoric acid | 0.20 | Z1 | 0.075 | Acidic |
| Inventive Example 55-26 | M-2 | A2 | B1 | 1.0 | 3000 | $ZrF_6^{2-}$ | 0.10 | Phosphoric acid | 0.20 | Z1 | 0.075 | Acidic |
| Inventive Example 55-27 | M-2 | A2 | B1 | 1.0 | 3000 | $ZrF_6^{2-}$ | 0.10 | Phosphoric acid | 0.20 | Z1 | 0.075 | Acidic |
| Inventive Example 55-28 | M-2 | A2 | B1 | 1.0 | 3000 | $TiF_6^{2-}$ | 0.10 | Phosphoric acid | 0.20 | Z1 | 0.075 | Acidic |
| Inventive Example 55-29 | M-2 | A2 | B1 | 1.0 | 3000 | $TiF_6^{2-}$ | 0.10 | Phosphoric acid | 0.20 | Z1 | 0.075 | Acidic |
| Inventive Example 55-30 | M-2 | A2 | B1 | 1.0 | 3000 | $ZrF_6^{2-}$ | 0,10 | Phosphoric acid | 0.20 | Z1 | 0.075 | Acidic |
| Inventive Example 55-31 | M-2 | A2 | B1 | 1.0 | 3000 | $ZrF_6^{2-}$ | 0.10 | Phosphoric acid | 0.20 | Z1 | 0.075 | Acidic |

TABLE 4-4

| | Time from plating to coating (sec) | Retention atmosphere humidity (%) | Retention time (sec) | Temperature change of plating layer (° C.) | Metal sheet entry temperature into coater (° C.) | Surface treatment metal material temperature (° C.) | Coating film retention time (sec) | Maximum reached sheet temperature (° C.) | Co treatment | Composite coating adhesion amount ($g/m^2$) |
|---|---|---|---|---|---|---|---|---|---|---|
| Inventive Example 5-1 | 29 | 81 | 4 | 343 | 30 | 30 | 2 | 100 | No | 0.3 |
| Inventive Example 5-2 | 49 | 86 | 4 | 356 | 30 | 30 | 2 | 100 | No | 0.3 |
| Inventive Example 5-3 | 65 | 83 | 3 | 295 | 30 | 30 | 2 | 100 | No | 0.3 |
| Inventive Example 5-4 | 5 | 68 | 2 | 323 | 30 | 30 | 2 | 100 | No | 0.3 |
| Inventive Example 5-5 | 20 | 82 | 3 | 303 | 30 | 30 | 2 | 100 | No | 0.3 |
| Inventive Example 5-6 | 17 | 83 | 2 | 363 | 30 | 30 | 2 | 100 | No | 0.3 |
| Inventive Example 5-7 | 10 | 92 | 7 | 386 | 30 | 30 | 2 | 100 | No | 0.3 |
| Inventive Example 5-8 | 55 | 83 | 4 | 324 | 30 | 30 | 2 | 100 | No | 0.3 |
| Inventive Example 5-9 | 2 | 52 | 5 | 353 | 30 | 30 | 2 | 100 | No | 0.3 |
| Inventive Example 5-10 | 42 | 91 | 5 | 316 | 30 | 30 | 2 | 100 | No | 0.3 |
| Inventive Example 5-11 | 60 | 81 | 5 | 323 | 30 | 30 | 2 | 100 | No | 0.3 |
| Inventive Example 5-12 | 5 | 92 | 3 | 372 | 30 | 30 | 2 | 100 | No | 0.3 |
| Inventive Example 5-13 | 38 | 88 | 10 | 396 | 30 | 30 | 2 | 100 | No | 0.3 |
| Inventive Example 5-14 | 65 | 82 | 4 | 387 | 30 | 30 | 2 | 100 | No | 0.3 |
| Inventive Example 5-15 | 50 | 88 | 2 | 334 | 30 | 30 | 2 | 100 | No | 0.3 |
| Inventive Example 5-16 | 34 | 90 | 5 | 328 | 30 | 30 | 2 | 100 | No | 0.3 |
| Inventive Example 5-17 | 34 | 80 | 4 | 313 | 30 | 30 | 2 | 100 | No | 0.3 |
| Inventive Example 5-18 | 37 | 81 | 3 | 309 | 30 | 30 | / | 100 | No | 0.3 |
| Inventive Example 5-19 | 85 | 94 | 5 | 463 | 30 | 30 | 2 | 100 | No | 0.3 |

TABLE 4-5

| | Time from plating to coating (sec) | Retention atmosphere humidity (%) | Retention time (sec) | Temperature change of plating layer (° C.) | Metal sheet entry temperature into coater (° C.) | Surface treatment metal material temperature (° C.) | Coating film retention time (sec) | Maximum reached sheet temperature (° C.) | Co treatment | Composite coating adhesion amount ($g/m^2$) |
|---|---|---|---|---|---|---|---|---|---|---|
| Inventive Example 5-20 | 29 | 92 | 4 | 377 | 30 | 30 | 2 | 100 | No | 0.3 |
| Inventive Example 5-21 | 26 | 89 | 3 | 343 | 30 | 30 | 2 | 100 | No | 0.3 |
| Inventive Example 5-22 | 43 | 80 | 3 | 354 | 30 | 30 | 2 | 100 | No | 0.3 |
| Inventive Example 5-23 | 20 | 86 | 2 | 355 | 30 | 30 | 2 | 100 | No | 0.3 |
| Inventive Example 5-24 | 16 | 82 | 2 | 354 | 30 | 30 | 2 | 100 | No | 0.3 |

TABLE 4-5-continued

| | Time from plating to coating (sec) | Retention atmosphere humidity (%) | Retention time (sec) | Temperature change of plating layer (° C.) | Metal sheet entry temperature into coater (° C.) | Surface treatment metal material temperature (° C.) | Coating film retention time (sec) | Maximum reached sheet temperature (° C.) | Co treat-ment | Composite coating adhesion amount (g/m$^2$) |
|---|---|---|---|---|---|---|---|---|---|---|
| Inventive Example 5-25 | 60 | 80 | 4 | 367 | 30 | 30 | 2 | 100 | No | 0.3 |
| Inventive Example 5-26 | 60 | 82 | 2 | 324 | 30 | 30 | 2 | 100 | No | 0.3 |
| Inventive Example 5-27 | 60 | 80 | 4 | 320 | 30 | 30 | 2 | 100 | No | 0.3 |
| Inventive Example 55-1 | 11 | 85 | 4 | 343 | 30 | 30 | 2 | 100 | No | 0.3 |
| Inventive Example 55-2 | 15 | 48 | 2 | 357 | 30 | 30 | 2 | 100 | No | 0.3 |
| Inventive Example 55-3 | 53 | 80 | 3 | 300 | 30 | 30 | 2 | 100 | No | 0.3 |
| Inventive Example 55-4 | 23 | 84 | 4 | 358 | 30 | 30 | 2 | 100 | No | 0.3 |
| Inventive Example 55-5 | 72 | 92 | 3 | 326 | 30 | 30 | 2 | 100 | No | 0.3 |
| Inventive Example 55-6 | 17 | 83 | 4 | 287 | 30 | 30 | 2 | 100 | No | 0.3 |
| Inventive Example 55-7 | 52 | 84 | 3 | 363 | 30 | 30 | 2 | 100 | No | 0.3 |
| Inventive Example 55-8 | 11 | 93 | 8 | 304 | 30 | 30 | 2 | 100 | No | 0.3 |
| Inventive Example 55-9 | 32 | 85 | 2 | 335 | 30 | 30 | 2 | 100 | Yes | 0.3 |
| Inventive Example 55-10 | 31 | 93 | 4 | 341 | 30 | 30 | 2 | 100 | No | 0.3 |
| Inventive Example 55-11 | 31 | 90 | 3 | 355 | 30 | 30 | 2 | 100 | No | 0.3 |

TABLE 4-6

| | Time from plating to coating (sec) | Retention atmosphere humidity (%) | Retention time (sec) | Temperature change of plating layer (° C.) | Metal sheet entry temperature into coater (° C.) | Surface treatment metal material temperature (° C.) | Coating film retention time (sec) | Maximum reached sheet temperature (° C.) | Co treat-ment | Composite coating adhesion amount (g/m$^2$) |
|---|---|---|---|---|---|---|---|---|---|---|
| Inventive Example 55-12 | 17 | 80 | 3 | 315 | 30 | 30 | 2 | 100 | No | 0.3 |
| Inventive Example 55-13 | 12 | 84 | 5 | 372 | 30 | 30 | 2 | 100 | Yes | 0.3 |
| Inventive Example 55-14 | 10 | 87 | 4 | 300 | 30 | 30 | 2 | 100 | No | 0.3 |
| Inventive Example 55-15 | 54 | 88 | 3 | 331 | 30 | 30 | 2 | 100 | No | 0.3 |
| Inventive Example 55-16 | 19 | 80 | 4 | 379 | 30 | 30 | 2 | 100 | No | 0.3 |
| Inventive Example 55-17 | 43 | 91 | 4 | 360 | 30 | 30 | 2 | 100 | No | 0.3 |
| Inventive Example 55-18 | 48 | 82 | 3 | 306 | 30 | 30 | 2 | 100 | No | 0.3 |
| Inventive Example 55-19 | 48 | 91 | 3 | 300 | 30 | 30 | 2 | 100 | No | 0.3 |
| Inventive Example 55-20 | 7 | 80 | 1 | 315 | 30 | 30 | 2 | 100 | Yes | 0.3 |
| Inventive Example 55-21 | 23 | 80 | 2 | 320 | 30 | 30 | 2 | 100 | No | 0.3 |
| Inventive Example 55-22 | 17 | 86 | 2 | 393 | 30 | 30 | 2 | 100 | No | 0.3 |
| Inventive Example 55-23 | 10 | 91 | 4 | 326 | 30 | 30 | 2 | 100 | No | 0.3 |
| Inventive Example 55-24 | 20 | 87 | 7 | 391 | 30 | 30 | 2 | 100 | No | 0.3 |
| Inventive Example 55-25 | 60 | 80 | 3 | 324 | 30 | 30 | 2 | 100 | No | 0.3 |
| Inventive Example 55-26 | 32 | 93 | 3 | 369 | 30 | 30 | 2 | 100 | No | 0.3 |
| Inventive Example 55-27 | 70 | 68 | 2 | 276 | 30 | 30 | 2 | 100 | No | 0.3 |
| Inventive Example 55-28 | 60 | 84 | 4 | 363 | 30 | 30 | 2 | 100 | No | 0.3 |
| Inventive Example 55-29 | 40 | 81 | 3 | 314 | 30 | 30 | 2 | 100 | No | 0.3 |
| Inventive Example 55-30 | 52 | 93 | 3 | 300 | 30 | 30 | 2 | 100 | No | 0.3 |
| Inventive Example 55-31 | 56 | 72 | 3 | 353 | 30 | 30 | 2 | 100 | No | 0.3 |

With respect to the obtained composite coating, the maximum value of V/Zn, the area ratio of the region in which V/Zn is 0.010 to 0.100 to the entire measurement range, the maximum value of V/Si, the average value of (Zr+Ti)/Si, the average value of P/Si, and the average value of V/Si were measured using micro-fluorescent X-rays in the same manner as in Example 1.

[Corrosion Resistance]

Further, the corrosion resistance of the obtained surface-treated metal material was evaluated.

In order to evaluate the corrosion resistance, the salt spray test performed in Example 1 and the combined cycle test (CCT) in accordance with JASO M-609-91 were performed.

<Combined Cycle Test>

In the combined cycle corrosion test (CCT), the white rust generation rate was measured after 9 and 15 cycles of salt spray, in which (2 hours)→drying (4 hours)→wetting (2 hours) is set as one cycle using the manufactured plated steel sheet. The white rust generation rate was determined by binarizing the corrosion evaluation surface of the plating layer, determining a threshold value at which a non-corroded portion and a white rust portion could be separated from each other, and measuring an area ratio of a white portion using image processing software. The evaluation criteria are as follows.

<Evaluation Criteria>

3: white rust generation area ratio is less than 5% of the total area

2: white rust generation area ratio is 5% or more and less than 20% of the total area 1: white rust generation area ratio is 20% or more of the total area Further, although not shown in the tables, all the examples of the salt spray test were evaluated as 3 or more.

The results are shown in Tables 5-1 to 5-3.

TABLE 5-1

| | Composite coating | | | | | | Corrosion resistance in salt spray test (9 cycles) | | | Corrosion resistance in salt spray test (15 cycles) | | |
|---|---|---|---|---|---|---|---|---|---|---|---|---|
| | Maximum value of V/Zn | Area ratio of V concentrated region | Maximum value of V/Si | Average value of (Zr + Ti)/Si | Average value of P/Si | Average value of V/Si | N1 | N2 | N3 | N1 | N2 | N3 |
| Inventive Example 5-1 | 0.048 | 3 | 21.5 | 0.11 | 0.19 | 0.04 | 3 | 3 | 3 | 3 | 3 | 3 |
| Inventive Example 5-2 | 0.025 | 31 | 12.0 | 0.10 | 0.22 | 0.05 | 3 | 3 | 3 | 3 | 3 | 3 |
| Inventive Example 5-3 | 0.016 | 2 | 44.7 | 0.07 | 0.23 | 0.09 | 3 | 3 | 3 | 2 | 2 | 3 |
| Inventive Example 5-4 | 0.019 | 9 | 32.2 | 0.13 | 0.17 | 0.02 | 3 | 3 | 3 | 2 | 2 | 3 |
| Inventive Example 5-5 | 0.015 | 2 | 11.1 | 0.09 | 0.19 | 0.06 | 3 | 3 | 3 | 3 | 3 | 3 |
| Inventive Example 5-6 | 0.013 | 6 | 34.2 | 0.12 | 0.20 | 0.04 | 3 | 3 | 3 | 3 | 3 | 3 |
| Inventive Example 5-7 | 0.026 | 40 | 24.4 | 0.11 | 0.20 | 0.06 | 3 | 3 | 3 | 3 | 3 | 3 |
| Inventive Example 5-8 | 0.046 | 37 | 41.4 | 0.08 | 0.21 | 0.05 | 3 | 3 | 3 | 3 | 3 | 3 |
| Inventive Example 5-9 | 0.019 | 26 | 67.2 | 0.02 | 0.28 | 0.12 | 3 | 2 | 3 | 2 | 2 | 3 |
| Inventive Example 5-10 | 0.022 | 37 | 54.3 | 0.09 | 0.21 | 0.06 | 3 | 3 | 3 | 3 | 3 | 3 |
| Inventive Example 5-11 | 0.046 | 31 | 32.7 | 0.11 | 0.20 | 0.05 | 3 | 3 | 3 | 3 | 3 | 3 |
| Inventive Example 5-12 | 0.020 | 2 | 44.0 | 0.08 | 0.22 | 0.06 | 3 | 3 | 3 | 3 | 3 | 3 |
| Inventive Example 5-13 | 0.023 | 3 | 32.1 | 0.10 | 0.21 | 0.06 | 3 | 3 | 3 | 3 | 3 | 3 |
| Inventive Example 5-14 | 0.013 | 7 | 19.1 | 0.08 | 0.21 | 0.05 | 3 | 3 | 3 | 3 | 3 | 3 |
| Inventive Example 5-15 | 0.061 | 49 | 28.8 | 0.10 | 0.21 | 0.05 | 3 | 3 | 3 | 3 | 3 | 3 |
| Inventive Example 5-16 | 0.082 | 34 | 53.8 | 0.11 | 0.21 | 0.06 | 3 | 3 | 3 | 3 | 3 | 3 |
| Inventive Example 5-17 | 0.029 | 11 | 35.1 | 0.10 | 0.19 | 0.05 | 3 | 3 | 3 | 3 | 3 | 3 |
| Inventive Example 5-18 | 0.016 | 5 | 20.7 | 0.08 | 0.21 | 0.06 | 3 | 3 | 3 | 3 | 3 | 3 |
| Inventive Example 5-19 | 0.085 | 34 | 78.1 | 0.14 | 0.16 | 0.09 | 3 | 3 | 3 | 2 | 2 | 3 |

TABLE 5-2

| | Composite coating | | | | | | Corrosion resistance in salt spray test (9 cycles) | | | Corrosion resistance in salt spray test (15 cycles) | | |
|---|---|---|---|---|---|---|---|---|---|---|---|---|
| | Maximum value of V/Zn | Area ratio of V concentrated region | Maximum value of V/Si | Average value of (Zr + Ti)/Si | Average value of P/Si | Average value of V/Si | N1 | N2 | N3 | N1 | N2 | N3 |
| Inventive Example 5-20 | 0.015 | 10 | 11.5 | 0.09 | 0.19 | 0.06 | 3 | 3 | 3 | 3 | 3 | 3 |
| Inventive Example 5-21 | 0.018 | 4 | 33.3 | 0.09 | 0.19 | 0.05 | 3 | 3 | 3 | 3 | 3 | 3 |
| Inventive Example 5-22 | 0.026 | 5 | 29.6 | 0.10 | 0.21 | 0.07 | 3 | 3 | 3 | 3 | 3 | 3 |
| Inventive Example 5-23 | 0.093 | 38 | 60.0 | 0.11 | 0.19 | 0.07 | 3 | 3 | 3 | 3 | 3 | 3 |
| Inventive Example 5-24 | 0.080 | 16 | 83.6 | 0.11 | 0.21 | 0.05 | 3 | 3 | 3 | 3 | 3 | 3 |
| Inventive Example 5-25 | 0.017 | 14 | 8.4 | 0.11 | 0.21 | 0.04 | 3 | 3 | 3 | 3 | 3 | 3 |
| Inventive Example 5-26 | 0.018 | 7 | 31.3 | 0.10 | 0.22 | 0.05 | 3 | 3 | 3 | 3 | 3 | 3 |
| Inventive Example 5-27 | 0.013 | 14 | 34.6 | 0.10 | 0.20 | 0.06 | 3 | 3 | 3 | 3 | 3 | 3 |
| Inventive Example 55-1 | 0.025 | 16 | 74.3 | 0.11 | 0.20 | 0.07 | 3 | 3 | 3 | 3 | 3 | 3 |
| Inventive Example 55-2 | 0.055 | 2 | 18.4 | 0.12 | 0.21 | 0.05 | 3 | 3 | 3 | 3 | 3 | 3 |
| Inventive Example 55-3 | 0.014 | 7 | 2.4 | 0.11 | 0.20 | 0.04 | 3 | 3 | 3 | 3 | 3 | 3 |
| Inventive Example 55-4 | 0.072 | 37 | 87.6 | 0.10 | 0.21 | 0.05 | 3 | 3 | 3 | 3 | 3 | 3 |
| Inventive Example 55-5 | 0.024 | 21 | 56.1 | 0.10 | 0.19 | 0.05 | 3 | 3 | 3 | 3 | 3 | 3 |
| Inventive Example 55-6 | 0.093 | 48 | 48.4 | 0.12 | 0.19 | 0.06 | 3 | 3 | 3 | 3 | 3 | 3 |
| Inventive Example 55-7 | 0.092 | 16 | 5.9 | 0.11 | 0.20 | 0.05 | 3 | 3 | 3 | 3 | 3 | 3 |
| Inventive Example 55-8 | 0.018 | 6 | 37.3 | 0.09 | 0.21 | 0.05 | 3 | 3 | 3 | 3 | 3 | 3 |
| Inventive Example 55-9 | 0.027 | 8 | 1.2 | 0.09 | 0.19 | 0.06 | 3 | 3 | 3 | 3 | 3 | 3 |
| Inventive Example 55-10 | 0.036 | 23 | 30.0 | 0.08 | 0.19 | 0.05 | 3 | 3 | 3 | 3 | 3 | 3 |
| Inventive Example 55-11 | 0.012 | 5 | 9.3 | 0.09 | 0.19 | 0.04 | 3 | 3 | 3 | 3 | 3 | 3 |

TABLE 5-3

| | Composite coating | | | | | | Corrosion resistance in salt spray test (9 cycles) | | | Corrosion resistance in salt spray test (15 cycles) | | |
|---|---|---|---|---|---|---|---|---|---|---|---|---|
| | Maximum value of V/Zn | Area ratio of V concentrated region | Maximum value of V/Si | Average value of (Zr + Ti)/Si | Average value of P/Si | Average value of V/Si | N1 | N2 | N3 | N1 | N2 | N3 |
| Inventive Example 55-12 | 0.019 | 14 | 43.3 | 0.11 | 0.20 | 0.06 | 3 | 3 | 3 | 3 | 3 | 3 |
| Inventive Example 55-13 | 0.019 | 10 | 28.2 | 0.11 | 0.21 | 0.06 | 3 | 3 | 3 | 3 | 3 | 3 |
| Inventive Example 55-14 | 0.015 | 10 | 37.6 | 0.11 | 0.22 | 0.06 | 3 | 3 | 3 | 3 | 3 | 3 |

TABLE 5-3-continued

| | Composite coating | | | | | | Corrosion resistance in salt spray test (9 cycles) | | | Corrosion resistance in salt spray test (15 cycles) | | |
|---|---|---|---|---|---|---|---|---|---|---|---|---|
| | Maximum value of V/Zn | Area ratio of V concentrated region | Maximum value of V/Si | Average value of (Zr + Ti)/Si | Average value of P/Si | Average value of V/Si | N1 | N2 | N3 | N1 | N2 | N3 |
| Inventive Example 55-15 | 0.027 | 37 | 45.4 | 0.09 | 0.21 | 0.07 | 3 | 3 | 3 | 3 | 3 | 3 |
| Inventive Example 55-16 | 0.012 | 9 | 22.4 | 0.10 | 0.20 | 0.06 | 3 | 3 | 3 | 3 | 3 | 3 |
| Inventive Example 55-17 | 0.076 | 21 | 10.4 | 0.10 | 0.19 | 0.06 | 3 | 3 | 3 | 3 | 3 | 3 |
| Inventive Example 55-18 | 0.028 | 3 | 38.3 | 0.09 | 0.22 | 0.06 | 3 | 3 | 3 | 3 | 3 | 3 |
| Inventive Example 55-19 | 0.023 | 8 | 25.1 | 0.09 | 0.20 | 0.05 | 3 | 3 | 3 | 3 | 3 | 3 |
| Inventive Example 55-20 | 0.025 | 5 | 42.5 | 0.07 | 0.24 | 0.01 | 3 | 3 | 3 | 2 | 3 | 2 |
| Inventive Example 55-21 | 0.012 | 5 | 45.5 | 0.09 | 0.22 | 0.04 | 3 | 3 | 3 | 3 | 3 | 3 |
| Inventive Example 55-22 | 0.063 | 46 | 47.8 | 0.11 | 0.21 | 0.06 | 3 | 3 | 3 | 3 | 3 | 3 |
| Inventive Example 55-23 | 0.027 | 9 | 8.6 | 0.12 | 0.19 | 0.04 | 3 | 3 | 3 | 3 | 3 | 3 |
| Inventive Example 55-24 | 0.027 | 3 | 48.4 | 0.09 | 0.21 | 0.05 | 3 | 3 | 3 | 3 | 3 | 3 |
| Inventive Example 55-25 | 0.016 | 14 | 22.9 | 0.10 | 0.22 | 0.06 | 3 | 3 | 3 | 3 | 3 | 3 |
| Inventive Example 55-26 | 0.020 | 10 | 42.9 | 0.09 | 0.20 | 0.05 | 3 | 3 | 3 | 3 | 3 | 3 |
| Inventive Example 55-27 | 0.026 | 14 | 32.6 | 0.17 | 0.12 | 0.15 | 3 | 2 | 3 | 2 | 2 | 3 |
| Inventive Example 55-28 | 0.076 | 35 | 59.8 | 0.10 | 0.19 | 0.04 | 3 | 3 | 3 | 3 | 3 | 3 |
| Inventive Example 55-29 | 0.011 | 5 | 22.5 | 0.09 | 0.20 | 0.05 | 3 | 3 | 3 | 3 | 3 | 3 |
| Inventive Example 55-30 | 0.017 | 14 | 42.9 | 0.09 | 0.21 | 0.05 | 3 | 3 | 3 | 3 | 3 | 3 |
| Inventive Example 55-31 | 0.092 | 23 | 96.6 | 0.08 | 0.20 | 0.06 | 3 | 3 | 3 | 3 | 3 | 3 |

As can be seen from Tables 4-1 to 5-3, when the average value of (Zr+Ti)/Si, the average value of P/Si, and the average value of V/Si were within the preferred ranges, the corrosion resistance in the combined cycle test was also improved.

INDUSTRIAL APPLICABILITY

According to the present invention, a surface-treated metal material excellent in corrosion resistance on the entire surface on which surface treatment has been performed and also excellent in heat resistance, fingerprint resistance, conductivity, coatability, and black doposit resistance during processing can be obtained. Therefore, industrial applicability thereof is high.

BRIEF DESCRIPTION OF THE REFERENCE SYMBOLS

11 metal sheet
12 plating layer
13 composite coating
21 oxide film
31 V compound

The invention claimed is:

1. A surface-treated metal material, comprising:
a metal sheet;
a plating layer formed on the metal sheet and containing aluminum, magnesium, and zinc; and
a composite coating formed on a surface of the plating layer, the composite coating including an organic silicon compound; a zirconium compound and/or a titanium compound; a phosphoric acid compound; a fluorine compound; and a vanadium compound,
wherein, when a surface of the composite coating is analyzed at a spot size of φ30 μm using micro-fluorescent X-rays, a maximum value of V/Zn, which is a mass ratio of a V content to a Zn content, is 0,010 to 0,100.

2. The surface-treated metal material according to claim 1, wherein, in the composite coating, when analyzed with the micro-fluorescent X-rays at a spot size of φ30 μm, an area ratio of a region in which the V/Zn is 0.010 to 0.100 to an entire measurement range is 1% to 50%.

3. The surface-treated metal material according to claim 1, wherein, in the composite coating, when analyzed with the micro-fluorescent X-rays at a spot size of φ30 μm, a maximum value of V/Si, which is a ratio of a solid content mass of V to a solid content mass of Si, is 1.0 to 100.

4. The surface-treated metal material according to claim 1, wherein, in the composite coating, when analyzed with the micro-fluorescent X-rays at a spot size of φ2 mm,
an average value of (Zr+Ti)/Si, which is a ratio of a total solid content mass of Zr and/or Ti to a solid content mass of Si, is 0.06 to 0.15,
an average value of P/Si, which is a ratio of a solid content mass of P to the solid content mass of Si, is 0.15 to 0.25, and
an average value of V/Si is 0.01 to 0.10.

5. The surface-treated metal material according to claim 1, wherein a chemical composition of the plating layer contains:
Al: more than 4.0% to less than 25.0%;
Mg: more than 1.0% to less than 12.5%;
Sn: 0% to 20%,
Bi: 0% to less than 5.0%;
In: 0% to less than 2.0%;
Ca: 0% to 3.0%;
Y: 0% to 0.5%;
La: 0% to less than 0.5%;
Ce: 0% to less than 0.5%:
Si: 0% to less than 2.5%;
Cr: 0% to less than 0.25%:
Ti: 0% to less than 0.25%;
Ni: 0% to less than 0.25%;
Co: 0% to less than 0.25%
V: 0% to less than 0.25%;
Nb: 0% to less than 0.25%;
Cu: 0% to less than 0.25%;
Mn: 0% to less than 0.25%:
Fe: 0% to 5.0%;
Sr: 0% to less than 0.5%;
Sb: 0% to less than 0.5%;
Pb: 0% to less than 0.5%; and
B: 0% to less than 0.5%,
with a remainder of Zn and impurities.

6. The surface-treated metal material according to claim 2, wherein, in the composite coating, when analyzed with the micro-fluorescent X-rays at a spot size of φ30 μm, a maximum value of V/Si, which is a ratio of a solid content mass of V to a solid content mass of Si, is 1.0 to 100.

* * * * *